US012735912B2

(12) United States Patent
Wang et al.

(10) Patent No.: US 12,735,912 B2
(45) Date of Patent: Sep. 15, 2026

(54) SWIMMING POOL ROBOT AND CONTROLLING METHOD THEREOF

(71) Applicant: XINGMAI INNOVATION TECHNOLOGY (SUZHOU) CO., LTD., Suzhou (CN)

(72) Inventors: Shengle Wang, Suzhou (CN); Shilei Zhang, Suzhou (CN)

(73) Assignee: XINGMAI INNOVATION TECHNOLOGY (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 19/370,711

(22) Filed: Oct. 27, 2025

(65) Prior Publication Data

US 2026/0049496 A1 Feb. 19, 2026

Related U.S. Application Data

(63) Continuation of application No. PCT/CN2024/087590, filed on Apr. 12, 2024.

(30) Foreign Application Priority Data

Apr. 27, 2023 (WO) ..... PCT/CN2023/091116
Sep. 8, 2023 (CN) ..... 202311159683.0
(Continued)

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
See application file for complete search history.

(56) References Cited

U.S. PATENT DOCUMENTS 4,466,154 A 8/1984 Urbani
6,039,886 A * 3/2000 Henkin ..... E04H 4/1654 210/167.2
(Continued)

FOREIGN PATENT DOCUMENTS

CN 201358597 Y 12/2009
CN 201921593 U 8/2011
(Continued)

OTHER PUBLICATIONS

AU2023206211—Examination Report No. 1 Mailed on Jul. 23, 2024, 3 pages.
(Continued)

*Primary Examiner* — Shay Karls
(74) *Attorney, Agent, or Firm* — ASHURST PERKINS COIE US LLP

(57) ABSTRACT

A swimming pool robot is disclosed, the swimming pool robot comprising: a first water inlet located at a bottom of the swimming pool robot, and is used for liquid to flow into the swimming pool robot; the swimming pool robot is configured to be switched from the bottom of the swimming pool to a liquid surface, wherein the first water inlet faces the bottom of the swimming pool when the swimming pool robot is on the bottom of the swimming pool or when the swimming pool robot is at the liquid surface; and when the swimming pool robot is switched from the bottom of the swimming pool to a liquid surface, the swimming pool robot has a state where the swimming pool robot is moving on a sidewall of the swimming pool.

17 Claims, 7 Drawing Sheets

(30) Foreign Application Priority Data

| | | |
|---|---|---|
| Nov. 17, 2023 | (CN) | 202311540590.2 |
| Feb. 5, 2024 | (WO) | PCT/CN2024/076021 |
| Feb. 5, 2024 | (WO) | PCT/CN2024/076025 |
| Feb. 5, 2024 | (WO) | PCT/CN2024/076033 |
| Feb. 5, 2024 | (WO) | PCT/CN2024/076040 |

(56) References Cited

U.S. PATENT DOCUMENTS

| | | | | |
|---|---|---|---|---|
| 6,294,084 | B1 * | 9/2001 | Henkin | E04H 4/1654 210/167.16 |
| 6,365,039 | B1 | 4/2002 | Henkin et al. | |
| 6,485,638 | B2 | 11/2002 | Henkin et al. | |
| 6,652,742 | B2 | 11/2003 | Henkin et al. | |
| RE38,479 | E | 3/2004 | Henkin et al. | |
| 6,758,719 | B1 | 7/2004 | Nava | |
| 6,842,931 | B2 | 1/2005 | Porat et al. | |
| 6,976,734 | B2 | 12/2005 | Stoewe | |
| 7,431,674 | B2 | 10/2008 | Van Der Leest et al. | |
| 8,623,201 | B2 | 1/2014 | Hui | |
| 8,997,293 | B2 | 4/2015 | Pichon et al. | |
| 9,133,639 | B2 | 9/2015 | Ben-Dov et al. | |
| 9,163,421 | B2 | 10/2015 | Van Der Meijden et al. | |
| 9,683,383 | B2 | 6/2017 | Shlomi-Shlomi et al. | |
| 10,294,686 | B1 | 5/2019 | Erlich et al. | |
| 10,378,229 | B2 | 8/2019 | Ben et al. | |
| 10,407,930 | B2 | 9/2019 | Renaud et al. | |
| 10,538,932 | B2 | 1/2020 | Goldenberg et al. | |
| 10,738,495 | B2 | 8/2020 | Durvasula et al. | |
| 10,865,581 | B2 | 12/2020 | Lancry et al. | |
| 10,878,317 | B2 | 12/2020 | Torem et al. | |
| 10,968,651 | B2 | 4/2021 | Van Der Meijden et al. | |
| 11,274,462 | B2 | 3/2022 | Tryber et al. | |
| 11,505,960 | B2 | 11/2022 | Witelson et al. | |
| 11,946,282 | B1 | 4/2024 | Zhang | |
| 11,988,018 | B2 | 5/2024 | Zhang | |
| 12,221,196 | B1 | 2/2025 | Liu et al. | |
| 12,371,918 | B2 | 7/2025 | Wang et al. | |
| 2004/0198069 | A1 | 10/2004 | Metzner et al. | |
| 2005/0083433 | A1 | 4/2005 | Wishart et al. | |
| 2011/0000031 | A1 | 1/2011 | Pichon et al. | |
| 2011/0049023 | A1 | 3/2011 | Hui | |
| 2012/0103365 | A1 | 5/2012 | Sumonthee | |
| 2014/0076789 | A1 | 3/2014 | Shlomi-Shlomi et al. | |
| 2014/0076791 | A1 | 3/2014 | Pichon et al. | |
| 2015/0067974 | A1 | 3/2015 | Ben Dov et al. | |
| 2015/0259940 | A1 | 9/2015 | Renaud et al. | |
| 2016/0060887 | A1 | 3/2016 | Tryber et al. | |
| 2016/0348981 | A1 | 12/2016 | Rodrick | |
| 2017/0356212 | A1 | 12/2017 | Hanan et al. | |
| 2017/0362844 | A1 | 12/2017 | Osuna et al. | |
| 2018/0208278 | A1 | 7/2018 | Klebanov et al. | |
| 2019/0161988 | A1 | 5/2019 | Attar et al. | |
| 2020/0001723 | A1 | 1/2020 | Durvasula et al. | |
| 2020/0077858 | A1 | 3/2020 | Zhang et al. | |
| 2021/0199525 | A1 | 7/2021 | Goldenberg et al. | |
| 2021/0330148 | A1 | 10/2021 | Sun et al. | |
| 2022/0112735 | A1 | 4/2022 | Besnier et al. | |
| 2022/0203560 | A1 | 6/2022 | Barel et al. | |
| 2022/0333394 | A1 | 10/2022 | Tryber et al. | |
| 2022/0389730 | A1 * | 12/2022 | Favie | E04H 4/1654 |
| 2023/0107841 | A1 | 4/2023 | Duffaut et al. | |
| 2024/0141667 | A1 | 5/2024 | Liu et al. | |
| 2024/0240482 | A1 | 7/2024 | Wang et al. | |
| 2024/0271445 | A1 | 8/2024 | Duffaut et al. | |
| 2024/0309664 | A1 | 9/2024 | Tryber et al. | |
| 2024/0360687 | A1 | 10/2024 | Zhang | |
| 2025/0012106 | A1 | 1/2025 | Winkler | |
| 2025/0333972 | A1 | 10/2025 | Li et al. | |

FOREIGN PATENT DOCUMENTS

| | | | | |
|---|---|---|---|---|
| CN | 102449251 | A | 5/2012 | |
| CN | 203361701 | U | 12/2013 | |
| CN | 104790696 | A | 7/2015 | |
| CN | 105371321 | B | 3/2018 | |
| CN | 109381121 | A | 2/2019 | |
| CN | 208481263 | U | 2/2019 | |
| CN | 209053474 | U | 7/2019 | |
| CN | 110670918 | A | 1/2020 | |
| CN | 111003111 | A | 4/2020 | |
| CN | 111155798 | A | 5/2020 | |
| CN | 111350383 | A | 6/2020 | |
| CN | 210768006 | U | 6/2020 | |
| CN | 111456507 | A | 7/2020 | |
| CN | 113774874 | A | 12/2021 | |
| CN | 215457656 | U | 1/2022 | |
| CN | 114059811 | A * | 2/2022 | E04H 4/1654 |
| CN | 114278129 | A | 4/2022 | |
| CN | 114305231 | A | 4/2022 | |
| CN | 114319955 | A | 4/2022 | |
| CN | 114352084 | A | 4/2022 | |
| CN | 216417046 | U | 5/2022 | |
| CN | 114278129 | B | 6/2022 | |
| CN | 114617488 | A | 6/2022 | |
| CN | 216690524 | U | 6/2022 | |
| CN | 216854601 | U | 7/2022 | |
| CN | 114837476 | A | 8/2022 | |
| CN | 114941458 | A | 8/2022 | |
| CN | 217524932 | U | 10/2022 | |
| CN | 217631555 | U | 10/2022 | |
| CN | 217736370 | U | 11/2022 | |
| CN | 217744228 | U | 11/2022 | |
| CN | 217925129 | U | 11/2022 | |
| CN | 218186696 | U | 1/2023 | |
| CN | 218265197 | U | 1/2023 | |
| CN | 218304772 | U | 1/2023 | |
| CN | 218306593 | U | 1/2023 | |
| CN | 218324137 | U | 1/2023 | |
| CN | 115680333 | A | 2/2023 | |
| CN | 115711055 | A | 2/2023 | |
| CN | 218467262 | U | 2/2023 | |
| CN | 116006001 | A | 4/2023 | |
| CN | 116145629 | A | 5/2023 | |
| CN | 116213387 | A | 6/2023 | |
| CN | 219118889 | U | 6/2023 | |
| CN | 219151050 | U | 6/2023 | |
| CN | 219316535 | U | 7/2023 | |
| CN | 219335258 | U | 7/2023 | |
| CN | 116696132 | A | 9/2023 | |
| CN | 116816154 | A | 9/2023 | |
| CN | 219638511 | U | 9/2023 | |
| CN | 116999943 | A | 11/2023 | |
| CN | 117120696 | A | 11/2023 | |
| CN | 117323733 | A | 1/2024 | |
| CN | 220539344 | U | 2/2024 | |
| DE | 102020104806 | B4 | 7/2022 | |
| EP | 2848751 | A1 | 3/2015 | |
| EP | 3012386 | A1 | 4/2016 | |
| EP | 3323963 | A1 | 5/2018 | |
| EP | 2706170 | B1 | 11/2020 | |
| EP | 3872280 | B1 | 7/2022 | |
| EP | 3845723 | B1 | 6/2023 | |
| JP | 1993092353 | U | 12/1993 | |
| JP | 2020500676 | A | 1/2020 | |
| JP | WO2020054476 | A1 | 10/2020 | |
| KR | 101402318 | B1 | 6/2014 | |
| KR | 101416657 | B1 | 7/2014 | |
| KR | 102258308 | B1 | 6/2021 | |
| WO | 9701689 | A1 | 1/1997 | |
| WO | 1997001689 | A1 | 1/1997 | |
| WO | 1997049504 | A1 | 12/1997 | |
| WO | 1999034077 | A1 | 7/1999 | |
| WO | 01036335 | A1 | 5/2001 | |
| WO | 2014185791 | A9 | 12/2014 | |
| WO | 2016044960 | A1 | 3/2016 | |
| WO | 2019007377 | A1 | 1/2019 | |

(56) References Cited

FOREIGN PATENT DOCUMENTS

| | | | |
|---|---|---|---|
| WO | 2019058286 | A1 | 3/2019 |
| WO | 2021100033 | A1 | 5/2021 |

OTHER PUBLICATIONS

AU2023206211—Examination Report No. 2 Mailed on Mar. 12, 2025, 4 pages.
AU2023206211—Notification of material filed by a third party Mailed on Dec. 19, 2024, 7 pages.
CN202311540590.2—First Office Action Mailed on Nov. 14, 2025, 10 pages.
CN202380010040.1—Third Office Action Mailed on Nov. 26, 2025, 14 pages.
EP23738415.1—Communication of a notice of opposition Mailed on Feb. 27, 2026, 126 pages.
EP23738415.1—Extended European Search Report Mailed on Aug. 13, 2024, 10 pages.
EP24795874.7—Extended European Search Report Mailed on Apr. 8, 2026, 10 pages.
EP25152420.3—Extended European Search Report Mailed on May 13, 2025, 7 pages.
EP25152420.3—Third Party Observation Mailed on Nov. 17, 2025, 8 pages.
EP25184347.0—Extended European Search Report Mailed on Nov. 6, 2025, 8 pages.
U.S. Appl. No. 18/353,263—Non-Final Office Action Mailed on Oct. 31, 2023, 8 pages.
U.S. Appl. No. 18/430,645—Non-Final Office Action Mailed on Jan. 7, 2026, 18 pages.
U.S. Appl. No. 18/430,645—Third-party submission under 37 CFR 1.290 Mailed on Mar. 24, 2025, 60 pages.
U.S. Appl. No. 18/946,861—Non-Final Office Action Mailed on Jan. 29, 2025, 21 pages.
U.S. Appl. No. 19/031,503—Third-party submission under 37 CFR 1.290 Mailed on Oct. 16, 2025, 24 pages.
U.S. Appl. No. 19/279,969—Non-Final Office Action Mailed on Dec. 30, 2025, 23 pages.
EP23738415.1—Supplemental Notice of Opposition Mailed on Apr. 30, 2026, 23 pages.
EP25152420.3—Communication Pursuant to Rule 114(2) EPC Mailed on May 19, 2026, 33 pages.

* cited by examiner

SWIMMING POOL ROBOT AND CONTROLLING METHOD THEREOF

CROSS-REFERENCE TO RELATED APPLICATIONS

The present application is a Continuation of International Application No. PCT/CN2024/087590, filed on Apr. 12, 2024, which claims priority to International Patent Application No. PCT/CN2023/091116, filed on Apr. 27, 2023 and entitled "MOVING APPARATUS USED IN LIQUID AND POOL CLEANING ROBOT", which is incorporated herein by reference in its entirety.

The present application claims priority to International Patent Application No. PCT/CN2024/076040, filed on Feb. 5, 2024 and entitled "CLEANING DEVICE", which is incorporated herein by reference in its entirety.

The present application claims priority to International Patent Application No. PCT/CN2024/076025, filed on Feb. 5, 2024 and entitled "CLEANING DEVICE", which is incorporated herein by reference in its entirety.

The present application claims priority to International Patent Application No. PCT/CN2024/076033, filed on Feb. 5, 2024 and entitled "MOVING APPARATUS USED IN LIQUID AND CLEANING DEVICE", which is incorporated herein by reference in its entirety.

The present application claims priority to International Patent Application No. PCT/CN2024/076021, filed on Feb. 5, 2024 and entitled "CLEANING DEVICE AND CLEANING DEVICE SYSTEM", which is incorporated herein by reference in its entirety.

The present application claims priority to Chinese Patent Application No. 202311159683.0, filed on Sep. 8, 2023 and entitled "FILTERING ASSEMBLY AND UNDERWATER CLEANING DEVICE", which is incorporated herein by reference in its entirety.

The present application claims priority to Chinese Patent Application No. 202311540590.2, filed on Nov. 17, 2023 and entitled "FILTERING ASSEMBLY AND UNDERWATER CLEANING DEVICE", which is incorporated herein by reference in its entirety.

TECHNICAL FIELD

The present disclosure relates to the technical field of robots, and in particular, to a moving apparatus, a cleaning device, and a cleaning device control method.

BACKGROUND OF THE INVENTION

Cleaning and maintenance of a liquid environment (such as a pool or a swimming pool) are essential to keep water clean and keep the pool hygienic. Cleaning devices on the market can be classified into three categories. For the first category, the cleaning device can clean the bottom of the liquid environment only. For the second category, the cleaning device can clean both the bottom and vertical wall surfaces of the liquid environment, but the cleaning device should operate under a liquid surface. For the third category, the cleaning device constantly floats on the liquid surface and cleans only the liquid surface. The three categories of cleaning devices have their own characteristics, but these cleaning devices cannot effectively adjust positions in the liquid environment and their depth in the liquid environment based on actual needs. As a result, the bottom of the liquid environment, the wall surfaces of the liquid environment, and the liquid surface cannot be cleaned in an all-round way.

Consequently, application ranges and operating efficiencies of these cleaning devices are limited.

Therefore, there is a need for a moving apparatus used in liquid and a cleaning device which can be flexibly switched between a position on a liquid surface and a position under the liquid surface, to improve the operating efficiency in cleaning water and the application range and reduce cleaning costs.

SUMMARY

The present disclosure provides a moving apparatus, a cleaning device, and a cleaning device control method to clean a liquid environment in an all-round way.

According to a first aspect, to address the aforementioned technical problem, the present disclosure provides a moving apparatus used in liquid. The moving apparatus used in liquid includes a front portion, a rear portion, and a mode switching member. The mode switching member is configured to implement pose switching of the moving apparatus between a second motion state and a third motion state. The mode switching member includes a buoyancy cavity, a first adjustment part, and at least one first injection opening. The buoyancy cavity is configured to accommodate gas or liquid. The first adjustment part is configured to adjust a volume of the gas or the liquid in the buoyancy cavity. The at least one first injection opening is provided at the front portion of the moving apparatus and communicates with the buoyancy cavity for external gas or external liquid to enter the buoyancy cavity. After the at least one first injection opening of the moving apparatus is exposed above a liquid surface, the first adjustment part is turned on to input gas into the buoyancy cavity through the at least one first injection opening, so that the rear portion of the moving apparatus moves toward the liquid surface, enabling the moving apparatus to be switched from the second motion state to the third motion state.

In some embodiments, the rear portion of the moving apparatus substantially rotates toward the liquid surface.

According to a second aspect, to address the aforementioned technical problem, the present disclosure provides a cleaning device. The cleaning device includes a front portion, a rear portion, and a mode switching member. The mode switching member is configured to implement pose switching of the cleaning device between a second motion state and a third motion state. The mode switching member includes a buoyancy cavity, a first adjustment part, at least one first injection opening, and a cleaning member. The buoyancy cavity is configured to accommodate gas or liquid. The first adjustment part is configured to adjust a volume of the gas or the liquid in the buoyancy cavity. The at least one first injection opening is provided at the front portion of the cleaning device and communicates with the buoyancy cavity for external gas or external liquid to enter the buoyancy cavity. The cleaning member includes a filtering mechanism that is at least partially located in the cleaning device. After the at least one first injection opening of the cleaning device is exposed above a liquid surface, the first adjustment part is turned on to input gas into the buoyancy cavity through the at least one first injection opening, so that the rear portion of the cleaning device moves toward the liquid surface, enabling the cleaning device to be switched from the second motion state to the third motion state.

In some embodiments, the cleaning device further includes a detection mechanism. The detection mechanism is configured to detect whether the first injection opening is exposed above the liquid surface.

In some embodiments, the filtering mechanism includes at least a first water flow path adapted to perform a cleaning operation in a first motion state or the second motion state.

In some embodiments, the filtering mechanism further includes a third water flow path adapted to perform a cleaning operation in the third motion state.

In some embodiments, the filtering mechanism further includes a second water flow path adapted to perform a non-cleaning operation. The second liquid path passes through a flow guiding opening provided on the filtering mechanism.

According to a third aspect, to address the aforementioned technical problem, the present disclosure provides a cleaning device control method. A cleaning device includes a front portion and a rear portion and is adapted to operate in liquid. The cleaning device includes at least a first suction opening, a mode switching member, a control system, a moving mechanism, and a propulsion mechanism. The mode switching member includes a buoyancy cavity, a first adjustment part, and a first injection opening. The control system is connected to the first adjustment part, the moving mechanism, and the propulsion mechanism via signals. The first suction opening is configured to allow the cleaning device to perform a cleaning operation in a third motion state. The method includes: controlling the cleaning device to operate in a second motion state until the first injection opening is exposed above a liquid surface; and controlling the first adjustment part to be turned on to input gas into the buoyancy cavity, so that the rear portion of the cleaning device moves toward the liquid surface until the cleaning device is switched from the second motion state to the third motion state. The second motion state includes a state in which the cleaning device moves on a side wall, and the third motion state includes a state in which the first suction opening of the cleaning device is at least partially located above or close to the liquid surface.

DETAILED DESCRIPTION OF THE INVENTION

The following clearly and comprehensively illustrates the technical solutions in some embodiments of the present disclosure with reference to the accompanying drawings. It is clear that the embodiments described below are merely some but not all of embodiments of the present disclosure. All other embodiments obtained by a person of ordinary skill in the art based on embodiments of the present disclosure without creative efforts shall fall within the protection scope of the present disclosure.

It should be noted that terms described in embodiments of the present disclosure, such as "first" and "second", are for descriptive purposes only and shall not be understood as an indication or implication of relative importance or an implicit indication of a quantity of indicated technical features. Therefore, a feature defined by "first" or "second" may explicitly or implicitly include one or more features.

An "embodiment" mentioned in this specification indicates that a particular feature, structure, or characteristic described with reference to this embodiment may be included in at least one embodiment of the present disclosure. The "embodiment" appeared anywhere in this specification may neither necessarily refer to a same embodiment, nor refer to an independent or optional embodiment exclusive from another embodiment. It is explicitly and implicitly understood by a person skilled in the art that embodiments described in this specification may be combined with another embodiment.

Currently, cleaning devices on the market cannot effectively adjust positions in a liquid environment and their depth in the liquid environment based on actual needs. As a result, the liquid environment (such as the bottom, a wall surface, and a liquid surface) cannot be cleaned in an all-round way. Consequently, application ranges and operating efficiencies of these cleaning devices are limited. The present disclosure provides a moving apparatus used in liquid. The moving apparatus used in liquid can be flexibly switched between a position on a liquid surface and a position under the liquid surface, so that a cleaning device that includes the moving apparatus can clean the liquid environment in an all-round way. This improves the operating efficiency in cleaning the liquid environment and the application range and reduces liquid environment cleaning costs. In some embodiments, the cleaning device may be a pool robot, a swimming pool robot, an underwater cleaning device, or the like. This is not limited herein.

Figure 1:
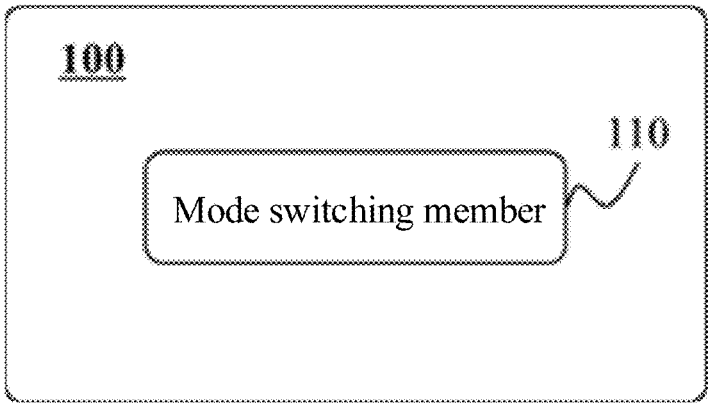
FIG. 1 is a simplified schematic structural view of a moving apparatus used in liquid according to an embodiment of the present disclosure.
Figure 2:
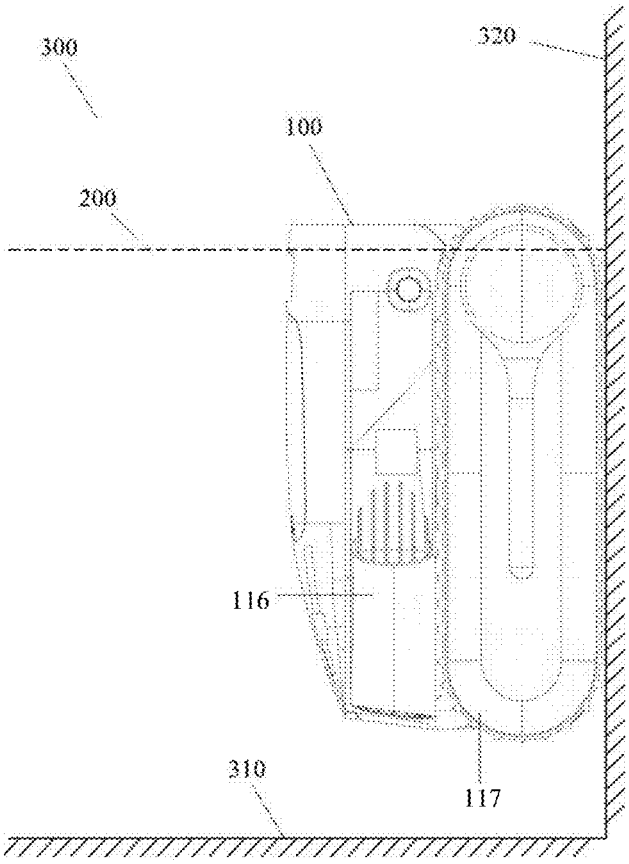
FIG. 2 is a first side view of a moving apparatus used in liquid according to the present disclosure.

FIG. 1 is a simplified schematic structural view of a moving apparatus used in liquid according to an embodiment of the present disclosure. FIG. 2 is a first side view of the moving apparatus used in liquid according to an embodiment of the present disclosure. The moving apparatus 100 used in liquid is configured to move within a target region 300 that contains liquid and may be switched between a position on a liquid surface 200 and a position under the liquid surface 200. The target region 300 may be a region in which the moving apparatus 100 moves and liquid is contained. For example, the target region 300 may be a pool, a swimming pool, an oil well, a sewer, or the like. This is not limited herein. It should be noted that, as shown in FIG. 2, the moving apparatus 100 used in liquid is configured to, in addition to moving within the target region 300 that contains liquid, move on a bottom wall 310 of the target region 300 and a side wall 320 of the target region 300.

Figure 3:
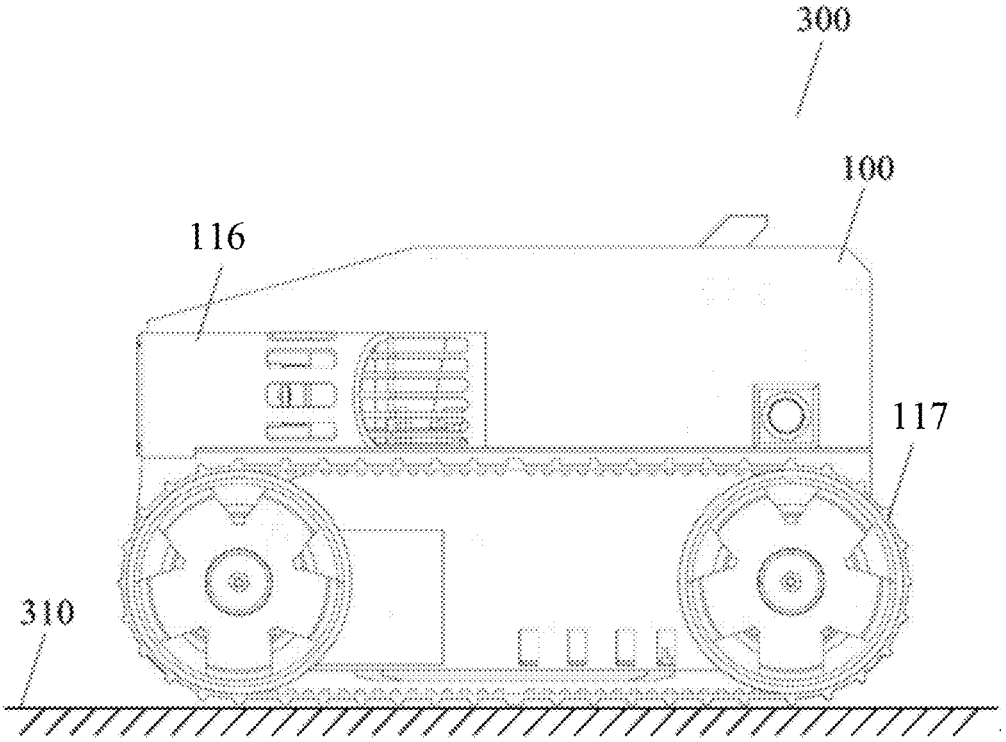
FIG. 3 is a second side view of a moving apparatus used in liquid according to the present disclosure.
Figure 4:
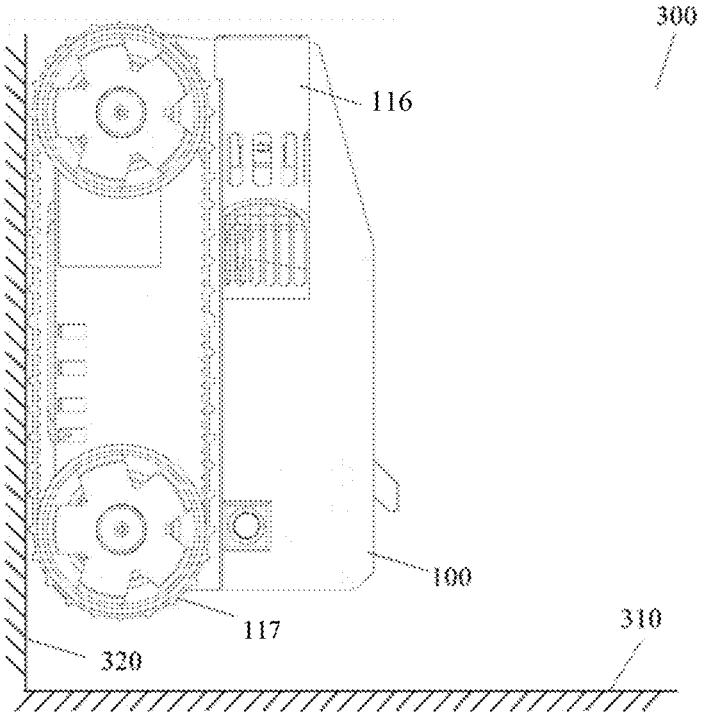
FIG. 4 is a third side view of a moving apparatus used in liquid according to the present disclosure.
Figure 5:
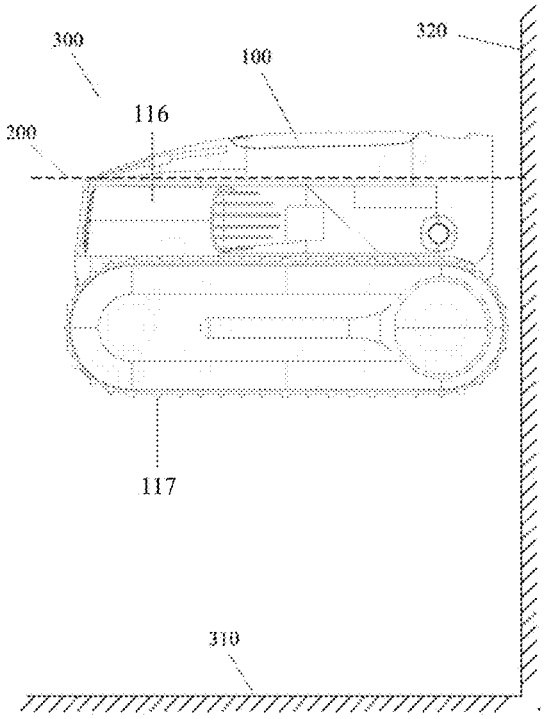
FIG. 5 is a fourth side view of a moving apparatus used in liquid according to the present disclosure.

The moving apparatus 100 used in liquid includes a mode switching member 110. The mode switching member 110 is configured to implement pose switching of the moving apparatus 100 between a second motion state and a third motion state. It should be noted that FIG. 3 is a second side view of the moving apparatus used in liquid. A first motion state is defined as a state in which the moving apparatus 100 moves on the bottom wall 310 or a state in which an angle between the bottom wall 310 and an overall direction of the moving apparatus 100 is less than 90° and the moving apparatus 100 is away from the liquid surface. That the moving apparatus 100 is away from the liquid surface may be understood as that the moving apparatus 100 performs bottom cleaning, performs an action underwater, and the like. FIG. 4 is a third side view of the moving apparatus used in liquid. The second motion state is defined as a state in which the moving apparatus 100 moves on the side wall 320 or a state in which an overall direction of the moving apparatus 100 is substantially parallel to the side wall 320. FIG. 5 is a fourth side view of the moving apparatus used in liquid. The third motion state is defined as a state in which the moving apparatus 100 moves on the liquid surface, a state in which the moving apparatus 100 is at least partially exposed above the liquid surface, or a state in which the moving apparatus 100 is entirely located under the liquid surface and close to the liquid surface. That the moving apparatus 100 is close to the liquid surface may be understood as that a distance between the moving apparatus 100 and the liquid surface is less than a threshold value, and the moving apparatus 100 can perform a liquid surface cleaning task and the like. The overall direction of the moving apparatus 100 is defined as a direction of a plane in which a moving mechanism of the moving apparatus 100 is in contact with a to-be-cleaned surface. For example, the moving mechanism is a track or a wheel. In the first motion state, the moving apparatus 100 may clean the bottom wall 310, process liquid in the pool, and the like. In the second motion state, the moving apparatus 100 may clean the side wall 320, clean a waterline, and the like. In the third motion state, the moving apparatus 100 may move on the liquid surface and clean the liquid surface. A process of cleaning the liquid surface may be understood as a process in which garbage floating on the liquid surface enters the interior of the moving apparatus 100 or the cleaning device through a suction opening of the moving apparatus 100 or the cleaning device.

The mode switching member 110 is configured to implement pose switching of the moving apparatus 100 between the position on the liquid surface 200 and the position under the liquid surface 200, so that the cleaning device that includes the moving apparatus 100 can flexibly switch poses between the position on the liquid surface 200 and the position under the liquid surface 200. Specifically, the mode switching member 110 is configured to allow the moving apparatus 100 to perform pose switching between the position on the liquid surface 200 and the position under the liquid surface 200 to be located on the liquid surface 200, so that the cleaning device that includes the moving apparatus 100 is switched to the third motion state and can perform liquid surface cleaning on the liquid environment. The mode switching member 110 is configured to allow the moving apparatus 100 to perform pose switching between the position on the liquid surface 200 and the position under the liquid surface 200 to be switched to the second motion state, so that the cleaning device can clean the pool wall, the waterline, and the like. In this way, the cleaning device can clean the liquid environment in an all-round way. This improves the operating efficiency in cleaning the liquid environment and the application range and reduces liquid environment cleaning costs.

The moving apparatus 100 may be constructed in various ways. For example, during liquid surface cleaning, the suction opening is provided at a side surface of a front portion of the apparatus, and the third motion state is a state in which the moving apparatus 100 is substantially horizontal or a state in which the front portion tilts slightly upward and a rear portion tilts slightly downward (which may be defined as a first tilting state). In this case, the suction opening is at least partially located under the liquid surface. When the suction opening is provided at the bottom of the apparatus, the suction opening may be a suction opening for pool bottom cleaning, and the third motion state is a state in which the side surface of the front portion of the moving apparatus 100 is obviously exposed above the liquid surface and the suction opening is at least partially exposed above the liquid surface or close to the liquid surface. In this case, to maintain balance of the apparatus, the rear portion of the apparatus is located under the liquid surface (which may be defined as a third tilting state), and a tilting degree of the apparatus is larger than that of the apparatus in the first tilting state. When the suction opening is provided at an intersection or a transition part between the front portion and the bottom of the apparatus, the third motion state is a state in which the intersection or the transition part is at least partially exposed above the liquid surface, so that the suction opening is at least partially exposed above the liquid surface or close to the liquid surface. In this case, the rear portion of the apparatus is lower than the front portion of the apparatus, and the rear portion of the apparatus may be entirely located underwater, or a side surface of the rear portion is at least partially exposed above the liquid surface.

A process in which the moving apparatus 100 is switched from the second motion state to the third motion state may be a process in which the moving apparatus 100 rotates around a first virtual axis substantially in a first direction. The first virtual axis is located inside the front portion of the moving apparatus 100. In other words, a distance over which the front portion of the apparatus rotates is less than a distance over which the rear portion of the apparatus rotates. During a process in which the moving apparatus 100 is switched from the third motion state to the second motion state, the moving apparatus 100 operates until the front portion abuts against a pool wall, and then the moving apparatus 100 rotates around a second virtual axis substantially in a second direction. The second virtual axis is also located inside the front portion of the moving apparatus 100. In other words, a distance over which the rear portion of the apparatus rotates is greater than a distance over which the front portion of the apparatus rotates. The first direction is opposite to the second direction.

In one embodiment, the mode switching member 110 is further configured to adjust an action force applied to the moving apparatus 100 in a vertical direction. Specifically, when the moving apparatus 100 is in the second motion state, the mode switching member 110 may adjust the action force applied to the moving apparatus 100 in the vertical direction, so that the moving apparatus 100 can be switched from the second motion state to the third motion state. When the moving apparatus 100 is in the third motion state, the mode switching member 110 may adjust the action force applied to the moving apparatus 100 in the vertical direction, so that the moving apparatus 100 can be switched from the third motion state to the second motion state or can be switched from the third motion state directly to the first motion state. In other words, the mode switching member 110 is configured to adjust the action force applied to the moving apparatus 100 in the vertical direction, so that the moving apparatus 100 can perform pose switching between the position on the liquid surface 200 and the position under the liquid surface 200.

It should be noted that, as shown in FIG. 2, the vertical direction may be a vertical direction of the target region 300, for example, a vertical direction of the pool, namely, a gravity direction, and a horizontal direction may be a horizontal direction of the target region 300, for example, a horizontal direction of the pool, namely, a direction perpendicular to the gravity direction.

In one embodiment, the action force applied to the moving apparatus 100 in the vertical direction may include a buoyancy force applied to the moving apparatus 100 in the vertical direction. The mode switching member 110 is further configured to adjust a magnitude of the buoyancy force applied to the moving apparatus 100 in the vertical direction. The buoyancy force applied to the moving apparatus 100 in the vertical direction changes, and a gravity of the moving apparatus 100 remains substantially unchanged. Therefore, the moving apparatus 100 can perform pose switching between the second motion state and the third motion state or between the first motion state and the third motion state, so that the moving apparatus 100 implements pose switching between the position on the liquid surface 200 and the position under the liquid surface 200. Specifically, when the moving apparatus 100 is in the second motion state, the mode switching member 110 adjusts the buoyancy force applied to the moving apparatus 100 in the vertical direction to increase, so that the moving apparatus 100 can be switched from the second motion state to the third motion state as the moving apparatus 100 moves. In this way, pose switching of the moving apparatus 100 from the position under the liquid surface 200 to the position on the liquid surface 200 is implemented. When the moving apparatus 100 is in the third motion state, the mode switching member 110 adjusts the buoyancy force applied to the moving apparatus 100 in the vertical direction to decrease, so that the moving apparatus 100 can be switched from the third motion state to the second motion state or the first motion state as the moving apparatus 100 moves. In this way, pose switching of the moving apparatus 100 from the position on the liquid surface 200 to the position under the liquid surface 200 is implemented.

It should be noted that, for the mode switching member provided with a rigid cavity, the gravity of the mode switching member is increased or decreased by increasing or decreasing a volume of liquid in the rigid cavity, so that the buoyancy force applied to the moving apparatus in the vertical direction is decreased or increased. In other words, for the moving apparatus that includes the mode switching member provided with the rigid cavity, although the gravity of the moving apparatus is adjusted, pose switching of the moving apparatus 100 between the position on the liquid surface and the position under the liquid surface is implemented essentially by adjusting the magnitude of the buoyancy force applied to the moving apparatus in the vertical direction.

Figure 6:
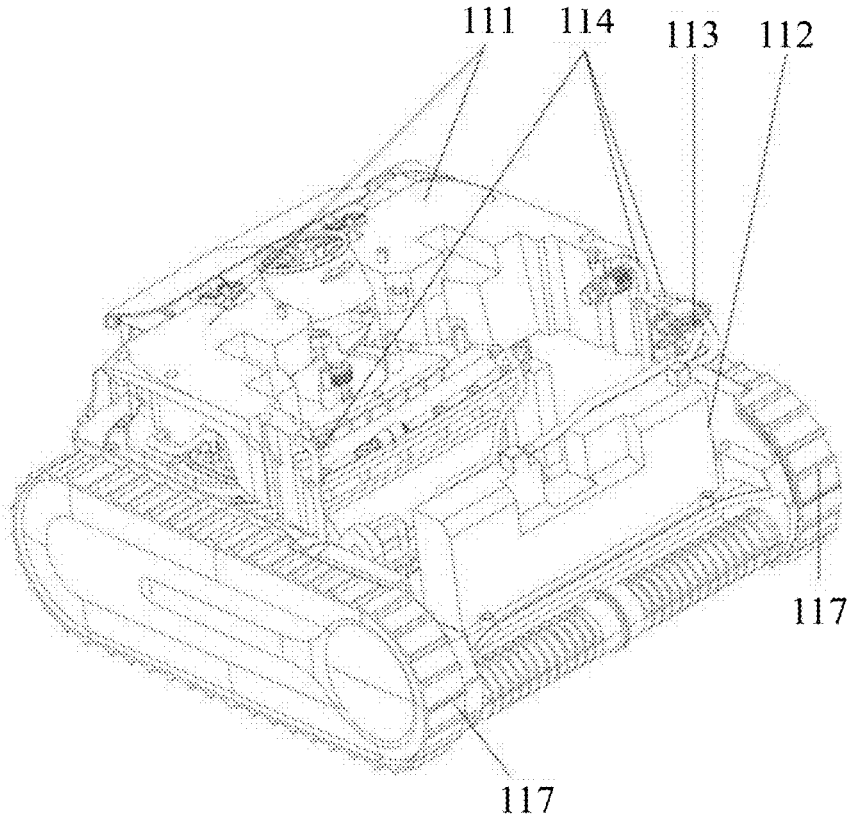
FIG. 6 is a first front view of a moving apparatus used in liquid according to the present disclosure.

FIG. 6 is a first front view of the moving apparatus used in liquid. In one embodiment, the mode switching member 110 includes a buoyancy cavity 111, a first adjustment part 112, and at least one first injection opening 113. The buoyancy cavity 111 is configured to accommodate gas or liquid. The first adjustment part 112 is configured to adjust a volume of the gas or liquid in the buoyancy cavity 111. The at least one first injection opening 113 communicates with the buoyancy cavity 111 to allow external gas or external liquid to enter the buoyancy cavity 111. After the first injection opening 113 of the moving apparatus 100 is exposed above the liquid surface, the first adjustment part 112 is turned on to input gas into the buoyancy cavity 111 through the first injection opening 113, so that the rear portion of the moving apparatus 100 moves toward the liquid surface. In this way, the moving apparatus 100 is switched from the second motion state to the third motion state. A change in the volume of the gas or liquid in the buoyancy cavity 111 may lead to a change in the magnitude of the buoyancy force applied to the moving apparatus 100 in the vertical direction, so that the moving apparatus 100 can be switched from the second motion state to the third motion state. In this way, pose switching of the moving apparatus 100 between the position on the liquid surface 200 and the position under the liquid surface 200 is implemented.

Figure 7:
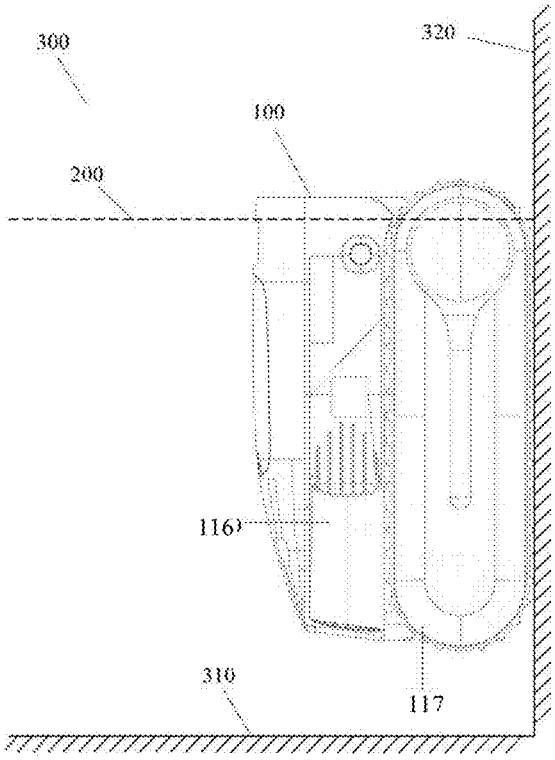
FIG. 7 is a fifth side view of a moving apparatus used in liquid according to the present disclosure.

Specifically, as shown in FIG. 4, when the moving apparatus 100 moves upward along the side wall 320 or moves upward along a direction substantially parallel to the side wall 320, the moving apparatus 100 is in the second motion state. FIG. 7 is a fifth side view of the moving apparatus used in liquid. As the moving apparatus 100 continues climbing upward along the side wall 320 or along the direction substantially parallel to the side wall 320 until the front portion of the moving apparatus 100 reaches the waterline, the first injection opening 113 is exposed above the liquid surface, and the first adjustment part 112 drives gas to be input into the buoyancy cavity 111 through the first injection opening 113. In this way, the volume of gas in the buoyancy cavity 111 is increased, and the buoyancy force applied to the moving apparatus 100 is increased. Because the front portion of the moving apparatus 100 is at least partially exposed above the liquid surface, the rear portion of the moving apparatus 100 floats upward. As shown in FIG. 5, the moving apparatus 110 begins to move from the vertical direction to a substantially horizontal direction until the rear portion of the moving apparatus 100 is at least partially exposed above the liquid surface. In this case, the moving apparatus 100 is in the third motion state and can perform liquid surface cleaning, and pose switching of the moving apparatus 100 from the second motion state to the third motion state is completed.

As shown in FIG. 6, the first injection opening 113 may be provided at the front portion of the moving apparatus 100. To increase the buoyancy force applied to the moving apparatus 100, the gas input into the buoyancy cavity 111 needs to enter the buoyancy cavity 111 through the first injection opening 113, and the gas may enter the buoyancy cavity 111 only when the first injection opening 113 is exposed above the liquid surface. Therefore, the first injection opening 113 is provided at the front portion of the moving apparatus 100, so that the first injection opening 113 is first exposed above the liquid surface 200 when the moving apparatus 100 is in the second motion state. In this way, when the moving apparatus 100 needs to perform pose switching, the gas is more quickly input into the buoyancy cavity 111 through the first injection opening 113 to implement pose switching of the moving apparatus 100 from the second motion state to the third motion state.

In one embodiment, the first injection opening 113 may be provided at the buoyancy cavity 111 or may be provided independent of the buoyancy cavity 111. In another embodiment, the first injection opening 113 may be provided at a housing of the moving apparatus 100, so that the first injection opening 113 communicates with the outside (for example, external liquid or external gas) for gas and/or liquid exchange.

In some embodiments, as shown in FIG. 3, the moving apparatus 100 further has the first motion state in which an underwater cleaning task is performed. The moving apparatus 100 may be switched from the first motion state to the second motion state and then switched from the second motion state to the third motion state, or may be switched from the third motion state to the second motion state and then switched from the second motion state to the first motion state. In other words, pose switching of the moving apparatus 100 among the first motion state, the second motion state, and the third motion state can be implemented.

Figure 10:
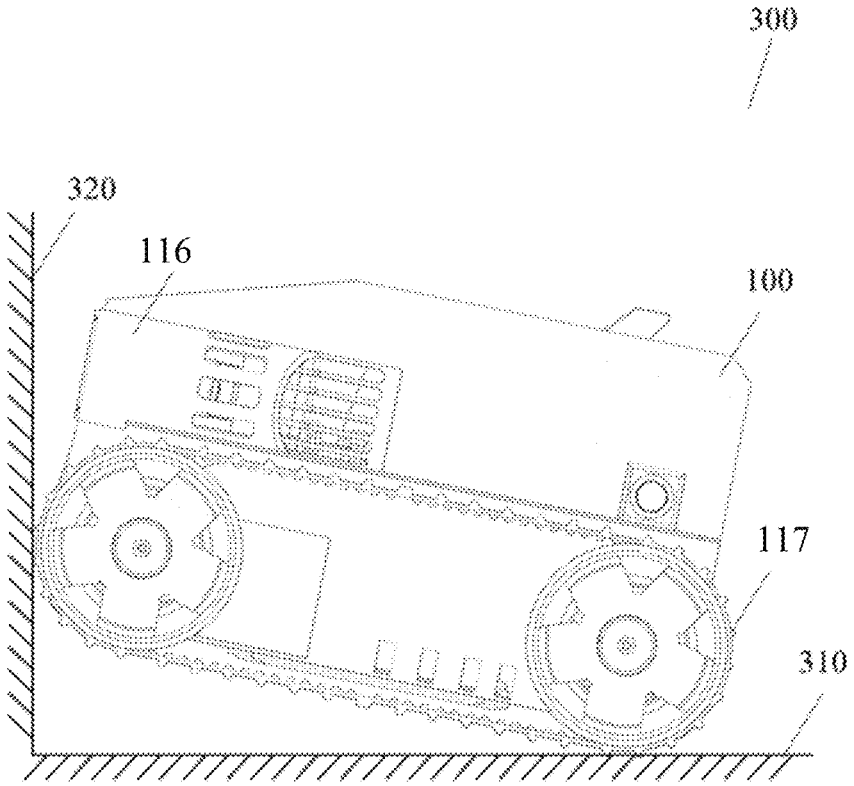
FIG. 10 is a sixth side view of a moving apparatus used in liquid according to the present disclosure.

Specifically, as shown in FIG. 3, when the moving apparatus 100 moves on the bottom wall 310, or when the angle between the bottom wall 310 and the overall direction of the moving apparatus 100 is less than 90° and the moving apparatus 100 is away from the liquid surface 200, the moving apparatus 100 is in the first motion state. As shown in FIG. 4, after the moving apparatus 100 completes underwater cleaning, the moving apparatus 100 reaches the side wall 320 and moves upward along the side wall 320, or as shown in FIG. 10, the moving apparatus 100 moves upward along the direction substantially parallel to the side wall 320. In this case, the moving apparatus 100 is in the second motion state. In this way, pose switching of the moving apparatus 100 from the first motion state to the second motion state is completed. Then, as shown in FIG. 7, the moving apparatus 100 moves along the side wall 320 to the waterline, and the first injection opening 113 is exposed above the liquid surface. As shown in FIG. 5, the first adjustment part 112 drives gas to be input into the buoyancy cavity 111 through the first injection opening 113. In this way, the volume of gas in the buoyancy cavity 111 is increased, so that the buoyancy force applied to the moving apparatus 100 is increased. Because the front portion of the moving apparatus 100 has been at least partially exposed above the liquid surface, the rear portion of the moving apparatus 100 floats upward. In this case, the moving apparatus 100 begins to move from the vertical direction to the substantially horizontal direction until the rear portion of the moving apparatus 100 is at least partially exposed above the liquid surface or the rear portion moves at least for a certain distance in a direction toward the liquid surface compared with a position at which the rear portion 102 of the moving apparatus 100 is located when the moving apparatus 100 is in the second motion state. In this case, the moving apparatus 100 is in the third motion state and can perform liquid surface cleaning, and pose switching of the moving apparatus 100 from the second motion state to the third motion state is completed.

After liquid surface cleaning is completed, the moving apparatus 100 may move to any waterline. In this case, the front portion of the moving apparatus substantially abuts against the waterline at the side wall, and the rear portion is away from the waterline at the side wall. Then, the first adjustment part 112 drives the gas in the buoyancy cavity 111 to be discharged through the first injection opening 113, so that the volume of gas in the buoyancy cavity 111 is decreased, and the buoyancy force applied to the moving apparatus 100 is decreased. In this way, the moving apparatus 100 begins to sink. In this case, a main water pump and/or the moving mechanism are/is in operation, the moving apparatus 100 begins to be switched from a horizontal state to a vertical state, and pose switching of the moving apparatus 100 from the third motion state to the second motion state is completed. It should be noted that, in a process in which the first adjustment part 112 adjusts the volume of gas in the buoyancy cavity 111 through the first injection opening 113, gas located in the buoyancy cavity 111 away from the first injection opening 113 may be generally discharged earlier than gas located in the buoyancy cavity 111 close to the first injection opening 113. In other words, a part of the moving apparatus 100 is away from the first injection opening 113, a part of the moving apparatus 100 is provided with the first injection opening 113, the part away from the first injection opening 113 first sinks until the moving apparatus 100 is switched to the second motion state, and then the part at which the first injection opening 113 is located sinks. In this way, the volume of gas in the buoyancy cavity 111 can be better adjusted. Then, the moving apparatus 100 may move downward along the side wall 320 or along the direction substantially parallel to the side wall 320 until the moving apparatus 100 abuts against the bottom wall 310. Finally, the moving apparatus 100 moves to the bottom wall 310. In this way, the moving apparatus 100 is switched from the second motion state to the first motion state. Alternatively, the moving apparatus 100 may begin to use the first adjustment part 112 to drive the gas in the buoyancy cavity 111 to be discharged through the first injection opening 113 at any position on the liquid surface, so that the volume of gas in the buoyancy cavity 111 is decreased, and the buoyancy force applied to the moving apparatus 100 is decreased. In this way, the moving apparatus 100 begins to sink. Until the moving apparatus 100 reaches a preset depth or directly sinks to the bottom wall 310, pose switching of the moving apparatus 100 from the third motion state to the first motion state is completed. In this process, it is to be ensured as much as possible that, the part at which the first injection opening 113 is located is submerged under the liquid surface last.

In one embodiment, the buoyancy cavity 111 further accommodates a chemical agent, or the chemical agent is accommodated in a chemical agent accommodating cavity that communicates with the buoyancy cavity 111. The chemical agent may be used to generate gas in a first preset triggering manner. The buoyancy cavity 111 is flexible. A volume of the buoyancy cavity 111 may change with the volume of gas in the buoyancy cavity 111. When the moving apparatus 100 is in the second motion state, the chemical agent is used to generate gas in the preset triggering manner, so that the volume of gas in the buoyancy cavity 111 that is in a deflated state is increased, and the volume of the buoyancy cavity 111 is increased accordingly. In this way, the buoyancy force applied to the moving apparatus 100 is increased, the moving apparatus 100 can be switched from the first motion state or the second motion state to the third motion state, and pose switching of the moving apparatus 100 from the position under the liquid surface 200 to the position on the liquid surface 200 is implemented. When the moving apparatus 100 is in the third motion state, the gas in the buoyancy cavity 111 can be restored to the chemical agent in a second preset triggering manner, so that the volume of gas in the buoyancy cavity 111 filled with gas is decreased, and the volume of the buoyancy cavity 111 is decreased accordingly. In this way, the buoyancy force applied to the moving apparatus 100 is decreased, the moving apparatus 100 can be switched from the third motion state to the second motion state or the first motion state, and pose switching of the moving apparatus 100 from the position on the liquid surface 200 to the position under the liquid surface 200 is implemented.

In some other embodiments, the buoyancy cavity 111 is flexible, and the volume of the buoyancy cavity 111 may change with the volume of gas in the buoyancy cavity 111. The first adjustment part 112 is a pump (for example, a pneumatic pump, a hydraulic pump, or an electric pump). The pump can drive gas to be input into/discharged from the buoyancy cavity 111, so that the volume of gas in the buoyancy cavity 111 is increased/decreased, and the volume of the buoyancy cavity 111 is increased/decreased. In this way, the volume of gas in the buoyancy cavity 111 is adjusted. When the moving apparatus 100 is in the second motion state, the pump drives the gas to be input into the buoyancy cavity 111 through the first injection opening 113, so that the volume of gas in the buoyancy cavity 111 that is in the deflated state is increased, and the volume of the buoyancy cavity 111 is increased accordingly. In this way, the buoyancy force applied to the moving apparatus 100 is increased, the moving apparatus 100 can be switched from the second motion state to the third motion state, and pose switching of the moving apparatus 100 from the position under the liquid surface 200 to the position on the liquid surface 200 is implemented. When the moving apparatus 100 is in the third motion state, the pump drives the gas to be discharged through the first injection opening 113, so that the volume of gas in the buoyancy cavity 111 is decreased, and the volume of the buoyancy cavity 111 is decreased accordingly. In this way, the buoyancy force applied to the moving apparatus 100 is decreased, and the moving apparatus 100 can be switched from the third motion state to the second motion state or can be switched from the third motion state directly to the first motion state.

It should be noted that, the gas driven by the pump may come from a gas tank provided in the moving apparatus 100 or may be external gas. When the gas driven by the pump comes from the gas tank, the moving apparatus 100 allows the gas to be input into the buoyancy cavity 111 through the first injection opening 113 on or under the liquid surface. In this way, the moving apparatus 100 can be directly switched from the first motion state to the third motion state, or can be switched from the first motion state to the second motion state and then switched from the second motion state to the third motion state. When the gas driven by the pump is the external gas, the gas may be input into the buoyancy cavity 111 through the first injection opening 113 only when the first injection opening 113 is exposed above the liquid surface. In addition, the buoyancy cavity 111 whose volume can change with the volume of gas therein is made of a flexible material. The flexible material may be, but is not limited to, polyvinyl alcohol resin, polyethylene terephthalate, rubber, or the like.

In one embodiment, as shown in FIG. 6, the mode switching member 110 further includes first connection ducts 114. In other words, the mode switching member 110 includes the buoyancy cavity 111, the first adjustment part 112, the at least one first injection opening 113, and the first connection ducts 114. Each first connection duct 114 is configured to transmit gas or liquid. The first connection ducts 114 may be connected to one or more of: the buoyancy cavity 111, the first adjustment part 112, and the first injection opening 113. As shown in FIG. 6, the moving apparatus 100 includes at least two buoyancy cavities 111, the first adjustment part 112, the first injection opening 113, and the first connection ducts 114. The buoyancy cavity 111 may be connected to the first adjustment part 112 through a first connection duct 114. The first adjustment part 112 may be connected to the first injection opening 113 through a first connection duct 114.

In some embodiments, the buoyancy cavity 111 is rigid. The moving apparatus 100 may further include a discharging opening (not shown in the figure). The first adjustment part 112 is a pump. When the moving apparatus 100 is in the third motion state, the pump drives the gas in the buoyancy cavity 111 to be discharged through the first injection opening 113, a negative pressure is generated in the buoyancy cavity due to a decrease in pressure inside the buoyancy cavity, and the negative pressure drives the liquid to be input into the buoyancy cavity 111 through the discharging opening. Therefore, in a case where the gas is discharged, and the liquid is input, a weight of the buoyancy cavity 111 is increased, and the buoyancy force applied to the moving apparatus 100 is decreased. In this way, the moving apparatus 100 can be switched from the third motion state to the second motion state or the first motion state, and pose switching of the moving apparatus 100 from the position on the liquid surface 200 to the position under the liquid surface 200 is implemented. When the moving apparatus 100 is in the second motion state, the pump drives gas to be input into the buoyancy cavity 111 through the first injection opening 113 and further drives the liquid in the buoyancy cavity 111 to be discharged through the discharging opening. Therefore, in a case where the gas is input, and the liquid is discharged, the weight of the buoyancy cavity 111 is decreased, and the buoyancy force applied to the moving apparatus 100 is increased. In this way, the moving apparatus 100 can be switched from the second motion state to the third motion state, and pose switching of the moving apparatus 100 from the position under the liquid surface 200 to the position on the liquid surface 200 is implemented.

It should be noted that, the volume of the buoyancy cavity 111 remains unchanged, that is, the buoyancy cavity 111 is made of a rigid material. The rigid material may be, but is not limited to, glass, ceramic, phenolic plastic, polyurethane plastic, epoxy plastic, unsaturated polyester plastic, or the like. A structure of the buoyancy cavity 111 is not limited herein. For example, the buoyancy cavity may be of a one-layer structure or a two-layer structure that includes an inner layer and an outer layer. The inner layer may be made of a flexible material and is configured to accommodate liquid and/or gas. The outer layer is a rigid accommodating housing and is configured to protect and stabilize the inner layer.

In one embodiment, the buoyancy cavity 111 may be provided at the front, the back, or the middle of the moving apparatus 100. This is not limited herein. In one embodiment, the moving apparatus 100 may be provided with one, two, three, or more buoyancy cavities 111. This is not limited herein. In one embodiment, there is one buoyancy cavity 111, and the buoyancy cavity 111 may be provided at a center position on the moving apparatus 100 to ensure that the moving apparatus 100 can remain stable when the volume of gas or liquid in the buoyancy cavity 111 changes.

In one embodiment, there are a plurality of buoyancy cavities 111. The plurality of buoyancy cavities 111 may include at least two side buoyancy cavities provided at different sides of the moving apparatus 100. The adjustment part 112 may be configured to adjust a volume of gas/liquid in each of the at least two side buoyancy cavities, to adjust a buoyancy force applied to each side buoyancy cavity. The at least two side buoyancy cavities may or may not communicate with each other. This is not limited herein. The plurality of buoyancy cavities 111 may be adjusted independently, so that buoyancy forces of different magnitudes can be applied to different parts of the moving apparatus 100. In this way, the moving apparatus 100 can have various postures. For example, when the moving apparatus 100 climbs to the waterline in the second motion state, the volume of liquid or gas in each of buoyancy cavities 111 at two sides is adjusted, so that buoyancy forces of different magnitudes can be applied to the two sides of the moving apparatus 100. For example, one side of the moving apparatus 100 is at least partially exposed above the liquid surface, and the other side of the moving apparatus is submerged. In this way, under the action of the moving mechanism and/or the pump, the moving apparatus 100 can move horizontally along the waterline at the side wall.

In one embodiment, the at least two side buoyancy cavities are respectively provided at two opposite sides of the moving apparatus 100. The adjustment part 112 may be configured to adjust the volume of gas/liquid in each of the at least two side buoyancy cavities, to adjust a difference between action forces applied to the at least two side buoyancy cavities in the vertical direction. In this way, pose switching of the moving apparatus 100 from the second motion state to the third motion state is implemented. When the at least two side buoyancy cavities are provided at the two opposite sides of the moving apparatus 100, the at least two side buoyancy cavities at the two opposite sides are provided substantially symmetrically. Symmetrically disposing the two side buoyancy cavities allows the moving apparatus 100 to remain stable when the side buoyancy cavities provide buoyancy forces for the moving apparatus 100. This prevents the moving apparatus 100 from tilting and deflecting due to an uneven buoyancy force applied to the moving apparatus 100 under or on the liquid surface 200.

In one embodiment, there are a plurality of buoyancy cavities 111. The plurality of buoyancy cavities 111 include at least two communicating buoyancy cavities that communicate with each other. Each communicating buoyancy cavity communicates with another communicating buoyancy cavity through a first injection port 113 thereof. When the plurality of communicating buoyancy cavities communicate with each other, the first adjustment part 112 may be disposed at a discharging opening of the first communicating buoyancy cavity or a discharging opening of the last communicating buoyancy cavity. When the plurality of communicating buoyancy cavities do not communicate with each other, liquid/gas in inner cavities of the plurality of communicating buoyancy cavities cannot exchange with each other. In this case, the first adjustment part 112 is disposed at a discharging opening of each communicating buoyancy cavity to control each communicating buoyancy cavity, or the plurality of communicating buoyancy cavities are provided with one first adjustment part 112 to control the plurality of communicating buoyancy cavities simultaneously.

For example, each communicating buoyancy cavity communicates with another buoyancy cavity through a first injection opening thereof and a second connection duct. For example, a first injection opening A1 and a discharging opening A2 are provided at a first communicating buoyancy cavity A, and a first injection opening B1 and a discharging opening B2 are provided at a second communicating buoyancy cavity B. The first communicating buoyancy cavity A may communicate with the second communicating buoyancy cavity B through the discharging opening A2 and the first injection opening B1. The discharging opening A2 communicates with the first injection opening B1 through the second connection duct. In this case, liquid is input into the second communicating buoyancy cavity B through the discharging opening B2, and then enters the first communicating buoyancy cavity A through the first injection opening B1, the second connection duct, and the discharging opening A2 in sequence.

In some embodiments, the moving apparatus 100 further includes a third connection duct (not shown in the figure). The third connection duct is configured to allow the first injection opening 113 to communicate with the outside. For example, the first injection opening A1 of the first communicating buoyancy cavity A is connected to the third connection duct, so that an inner cavity of the first communicating buoyancy cavity A and an inner cavity of the second communicating buoyancy cavity B communicate with the outside. In addition, gas may be discharged from or input into the first communicating buoyancy cavity A and the second communicating buoyancy cavity B through the first injection opening A1 and the third connection duct.

The third connection duct is connected to the discharging opening B2 of the second communicating buoyancy cavity B, so that the inner cavity of the first communicating buoyancy cavity A and the inner cavity of the second communicating buoyancy cavity B communicate with the outside. In addition, liquid may be discharged from or input into the first communicating buoyancy cavity A and the second communicating buoyancy cavity B through the discharging opening B2 and the second connection duct.

In one embodiment, the moving apparatus 100 further includes a processor (not shown in the figure). The processor is configured to perform position switching control of the moving apparatus 100 and/or posture switching control of the moving apparatus 100. The position switching control means that the adjustment part 112 is controlled to adjust the volume of gas/liquid in the buoyancy cavity 111 to change the buoyancy force applied to the buoyancy cavity 111. The posture switching control means that a variation of a target action force applied to the buoyancy cavity 111 is determined based on a current posture and a target posture of the moving apparatus 100, and the adjustment part 112 is controlled, based on the variation of the target action force, to adjust at least one of the volume of gas and the volume of liquid in the buoyancy cavity 111. The variation of the target action force is referred to as a change in action forces applied to the buoyancy cavity 111 before and after the buoyancy cavity 111 is adjusted. The moving apparatus 100 is switched from the current posture to the target posture in response to the change in action forces applied to the buoyancy cavity 111.

The processor may be a micro-controller, an embedded processor, an application-specific integrated circuit (ASIC), or the like. The processor may obtain various data information of the moving apparatus 100 and analyze and process the obtained data information, to control various components of the moving apparatus 100.

In one embodiment, when the moving apparatus 100 needs to be switched from being on the liquid surface 200 to under the liquid surface 200, or the moving apparatus 100 needs to move downward under the liquid surface 200 from a first underwater height to a second underwater height, in a case where an execution triggering condition is met, the processor may perform the position switching control: controlling the adjustment part 112 to decrease the volume of gas in the buoyancy cavity 111 and/or increase the weight of liquid in the buoyancy cavity 111. Alternatively, when the moving apparatus 100 needs to be switched from being on the liquid surface 200 to under the liquid surface 200, or the moving apparatus 100 needs to move downward under the liquid surface 200 from the first underwater height to the second underwater height, in a case where an execution triggering condition is met, the processor may perform the posture switching control to switch the moving apparatus 100 from the current posture to a wall climbing posture and then perform the position switching control: controlling the moving apparatus 100 to climb downward along the wall to be under the liquid surface 200.

In another embodiment, when the moving apparatus 100 needs to be switched from being under the liquid surface 200 to on the liquid surface 200, or the moving apparatus 100 needs to move upward under the liquid surface 200 from a first underwater height to a second underwater height, the processor may perform the position switching control: controlling the adjustment part 112 to increase the volume of gas in the buoyancy cavity 111 and/or decrease the weight of liquid in the buoyancy cavity 111. Alternatively, when the moving apparatus 100 needs to be switched from being under the liquid surface 200 to on the liquid surface 200, or the moving apparatus 100 needs to move upward under the liquid surface 200 from the first underwater height to the second underwater height, the processor may first perform the position switching control: controlling the moving apparatus 100 to climb upward along the wall under the liquid surface 200 to the second underwater height or to a boundary surface between liquid and air, and then perform the posture switching control to switch the moving apparatus 100 from the wall climbing posture to a preset posture.

In one embodiment, the moving apparatus 100 may further include a propeller. The moving apparatus 100 may be driven, under a driving force generated by the propeller, to move upward directly from being under the liquid surface 200 to on the liquid surface 200 or move upward under the liquid surface 200 from the first underwater height to the second underwater height. Alternatively, the moving apparatus 100 may be driven, under the driving force generated by the propeller, to move upward obliquely from being under the liquid surface 200 to on the liquid surface 200 or move upward under the liquid surface 200 from the first underwater height to the second underwater height.

In another embodiment, when the moving apparatus 100 needs to be switched from a first on-water posture to a second on-water posture or to be switched from a first underwater posture to a second underwater posture, the posture switching control is performed to switch the moving apparatus 100 from the first on-water posture to the second on-water posture or to switch the moving apparatus 100 from the first underwater posture to the second underwater posture. One of the first on-water posture and the second on-water posture is referred to as a surface operation posture, and the other one of the first on-water posture and the second on-water posture is referred to as a posture of horizontally moving along a waterline. One of the first underwater posture and the second underwater posture is referred to as a bottom operation posture, and the other one of the first underwater posture and the second underwater posture is referred to as the wall climbing posture.

In one embodiment, the moving apparatus 100 further includes a sensor (not shown in the figure). The sensor includes at least one of a first sensor and a second sensor. The first sensor is configured to detect a position of the moving apparatus 100. The second sensor is configured to detect whether the first injection opening 113 of the buoyancy cavity 111 is exposed above the liquid surface. The processor is further configured to, when the moving apparatus 100 needs to be switched from being under the liquid surface 200 to on the liquid surface 200, obtain information detected by the sensor, and in a case where the information detected by the sensor meets a preset condition, determine that the execution triggering condition is met. In a case where the information detected by the sensor includes the position of the moving apparatus 100, the preset condition includes a condition in which the position of the moving apparatus 100 meets a preset position. In a case where the information detected by the sensor includes a detection result of whether the first injection opening 113 of the buoyancy cavity 111 is exposed above the liquid surface, the preset condition includes a condition in which the first injection opening 113 of the buoyancy cavity 111 is exposed above the liquid surface.

The mode switching member 110 is disposed to adjust the magnitude of the buoyancy force applied to the moving apparatus 100, so that the moving apparatus 100 can perform posture switching among the first motion state, the second motion state, and the third motion state, and the moving apparatus 100 can be flexibly switched between being on the liquid surface 200 and under the liquid surface 200. This improves operation efficiency and reliability of the moving apparatus 100 in the liquid environment. The first sensor and the second sensor are disposed, so that the moving apparatus 100 can automatically determine an environment in which the first injection opening 113 is located. This improves the operation efficiency of the moving apparatus 100.

A position and a type of the first sensor are not limited herein. For example, the first sensor may be disposed at a center position of the moving apparatus 100. In other words, the position of the moving apparatus 100 detected by the first sensor is represented as a depth of the center position of the moving apparatus 100 in the liquid. The first sensor may be, but is not limited to, a pressure sensor, an ultrasonic sensor, an optical sensor, or the like. When the first sensor is the pressure sensor, the first sensor may be disposed on a region on the moving apparatus 100 in which water flow fluctuations are minimal or which is less affected by other factors, to improve detection accuracy. In addition, a position and a type of the second sensor are not limited herein. For example, the second sensor may be an ultrasonic sensor, a water exit sensor, or the like. The second sensor may be disposed at one first injection opening 113 of the buoyancy cavity 111. The second sensor may alternatively be disposed at other positions on the moving apparatus 100 and obtain, through position conversion, the detection result of whether the first injection opening 113 of the buoyancy cavity 111 is located in air.

In some embodiments, the action force applied to the moving apparatus 100 in the vertical direction may include a first driving force applied to the moving apparatus 100 in the vertical direction. The mode switching member 110 includes a driving force adjustment assembly configured to adjust the first driving force applied to the moving apparatus 100 in the vertical direction. A structure of the driving force adjustment assembly is not limited herein. The driving force adjustment assembly may be of any structure that can provide the first driving force. For example, the driving force adjustment assembly may be a screw propeller. The screw propeller may be vertically provided on the moving apparatus 100, so that the first driving force can be applied to the moving apparatus 100 in the vertical direction. The first driving force in the vertical direction may be upward or downward. Under the first driving force, the moving apparatus 100 may move upward or downward in the vertical direction, or may suspend somewhere in the liquid.

Figure 8:
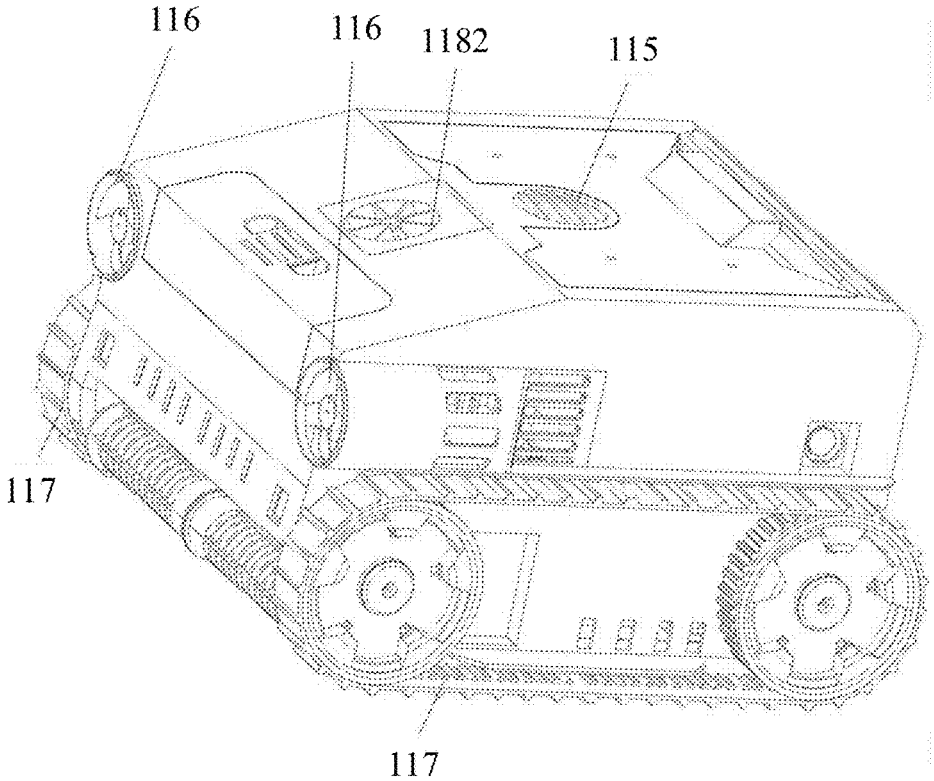
FIG. 8 is a second front view of a moving apparatus used in liquid according to the present disclosure.

FIG. 8 is a second front view of the moving apparatus used in liquid. In some embodiments, the driving force adjustment assembly includes at least one of a first propeller 115 and a second propeller 116. The first propeller 115 is configured to propel liquid to flow in a first preset direction. When the liquid flows in the first preset direction, the first driving force is applied to the moving apparatus 100 in the vertical direction. A magnitude of the first driving force is positively correlated with both a speed and a flow rate at which the liquid flows in the first preset direction. The second propeller 116 is configured to propel liquid to flow in a second preset direction. When the liquid flows in the second preset direction, a second driving force is applied to the moving apparatus 100 in the horizontal direction. A magnitude of the second driving force is positively correlated with a speed and a flow rate at which the liquid flows in the second preset direction. The second propeller 116 is disposed to implement position switching of the moving apparatus 100 in the horizontal direction. For example, the moving apparatus moves straight or turns around in the horizontal direction. In this way, the function of the moving apparatus 100 is expanded, so that the moving apparatus 100 can be applied to more scenarios. The first propeller 115 is disposed, so that the moving apparatus 100 can be quickly and conveniently switched between the position on the liquid surface 200 and the position under the liquid surface 200.

Figure 9:
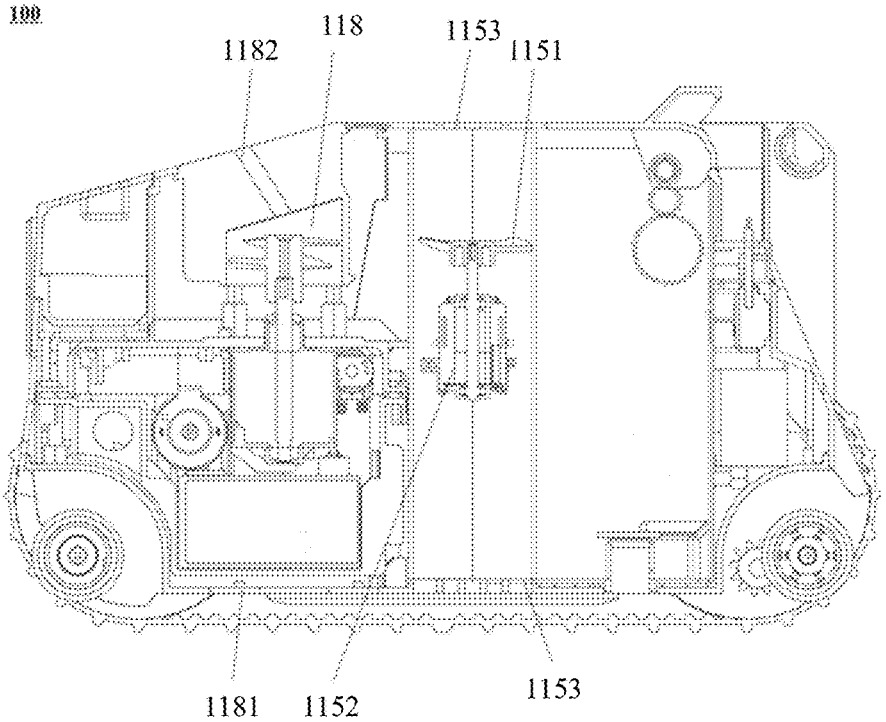
FIG. 9 is a first sectional view of a moving apparatus used in liquid according to the present disclosure.

In one embodiment, as shown in FIG. 8 and FIG. 9, the moving apparatus 100 may move in the target region 300 that contains liquid. The target region 300 includes the bottom wall 310 and the side wall 320. The moving apparatus 100 further includes at least one of a track 117, a main water pump 118, and a processor. The track 117 is configured to drive the moving apparatus 100 to move and switch a moving region of the moving apparatus 100 from the bottom wall 310 to the side wall 320. The main water pump 118 is configured to drive the moving apparatus 100 to suck liquid through a main pump water inlet 1181 and/or discharge liquid through a main pump water outlet 1182, to drive the moving apparatus 100 to be tightly attached to the side wall 320. The processor is configured to, after pose switching of moving apparatus 100 from being under the liquid surface 200 to on the liquid surface 200 is implemented by using the mode switching member 110, control the moving apparatus 100 to perform at least one of the following: cleaning, charging, filter cleaning, and landing.

Figure 11:
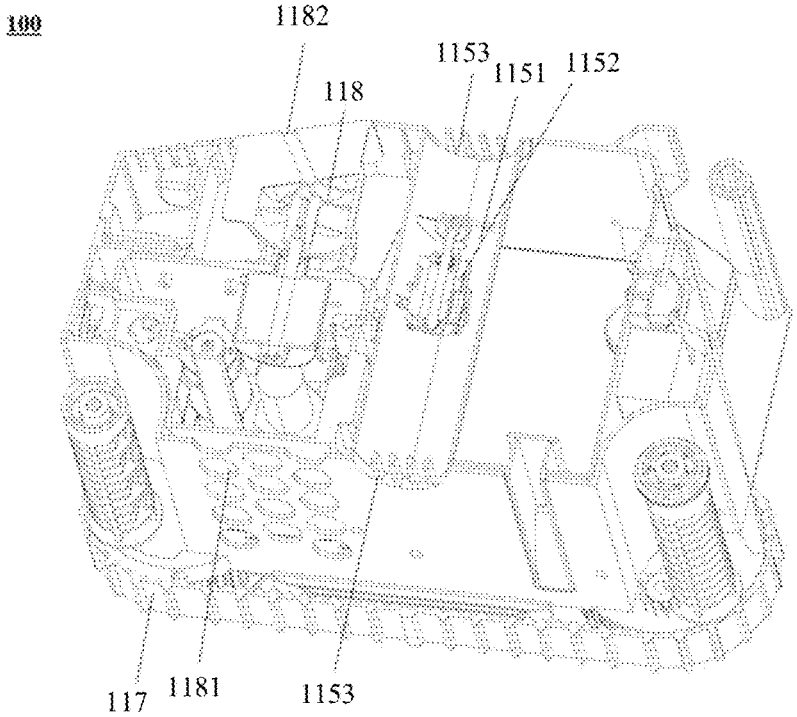
FIG. 11 is a first bottom view of a moving apparatus used in liquid according to the present disclosure.

The main water pump 118 is configured to drive the moving apparatus 100 to suck liquid through the main pump water inlet 1181 and to discharge liquid through the main pump water outlet 1182. The main pump water inlet 1181 may include at least one inlet for the liquid to enter the moving apparatus 100. FIG. 11 is a first bottom view of the moving apparatus used in liquid. The main pump water inlet 1181 of the moving apparatus 100 may be used as an inlet for the liquid to enter the moving apparatus 100, namely, a water inlet. The main pump water outlet 1182 may include at least one outlet for the liquid to leave the moving apparatus 100 and enter the target region 300. As shown in FIG. 11, the main pump water outlet 1182 of the moving apparatus 100 may be used as an outlet for the liquid in the moving apparatus 100 to leave the moving apparatus 100 and enter the target region 300, namely, a water outlet.

When the moving apparatus 100 is located on the side wall 320, the water outlet (for example, the main pump water outlet 1182) may at least face the target region 300 in a direction parallel to the horizontal direction or tilt downward in the vertical direction, to ensure that when the liquid is discharged through the main pump water outlet 1182 during operation of the main water pump 118, a third driving force is applied to the moving apparatus 100 to drive the moving apparatus 100 to be tightly attached to the side wall 320. The third driving force may be a reaction force applied to the moving apparatus 100 when the main water pump 118 discharges the liquid through the main pump water outlet 1182.

The main pump water inlet 1181 may be provided at the bottom of the moving apparatus 100. When the moving apparatus 100 needs to move on the side wall 320, the main water pump 118 is configured to suck the liquid through the main pump water inlet 1181 to obtain a fourth driving force to drive the moving apparatus 100 to be tightly attached to the side wall 320. The fourth driving force may be a suction force generated by the main water pump 118 sucking water through the main pump water inlet 1181. The suction force may drive the moving apparatus 100 to be tightly attached to the side wall 320.

When the moving apparatus 100 needs to move on the side wall 320, the main water pump 118 of the moving apparatus 100 may drive the moving apparatus 100 to be tightly attached to the side wall 320. At least one of the track 117, the second propeller 116, and the main water pump 118 of the moving apparatus 100 may provide an upward driving force in the vertical direction to drive the moving apparatus 100 to move upward on the side wall. At least one of the track 117 and the second propeller 116 of the moving apparatus 100 may further provide a downward driving force in the vertical direction to drive the moving apparatus 100 to move downward on the side wall 320.

The main water pump 118 is disposed, so that the moving apparatus 100 can be tightly attached to the side wall 320 to limit a position of the moving apparatus 100. In this way, the moving apparatus 100 can conveniently move on the side wall 320, clean the side wall 320, and be switched from the position under the liquid surface 200 to the position on the liquid surface 200.

In one embodiment, the moving apparatus 100 further includes a moving mechanism and a propulsion mechanism. The moving mechanism is mainly configured to drive the moving apparatus 100 to move in the first motion state or the second motion state. The propulsion mechanism is mainly configured to drive the moving apparatus 100 to move in the third motion state. The moving mechanism is provided at the bottom of the moving apparatus 100. The moving mechanism is configured to drive the moving apparatus 100 to move on a to-be-cleaned surface. The moving mechanism may include a wheel, or a wheel, the track 117, and the like. The propulsion mechanism is configured to drive the cleaning device to move away from the to-be-cleaned surface. The propulsion mechanism may include the first propeller 115 and/or the second propeller 116. Certainly, at least one of the main water pump 118, the main pump water inlet 1181, and the main pump water outlet 1182 in a drive mechanism may also provide a component force to drive the cleaning device to move on the to-be-cleaned surface or to move away from the to-be-cleaned surface. The to-be-cleaned surface may be the target bottom wall 310 or the target side wall 320 of the target region 300 or the like.

Figure 12:
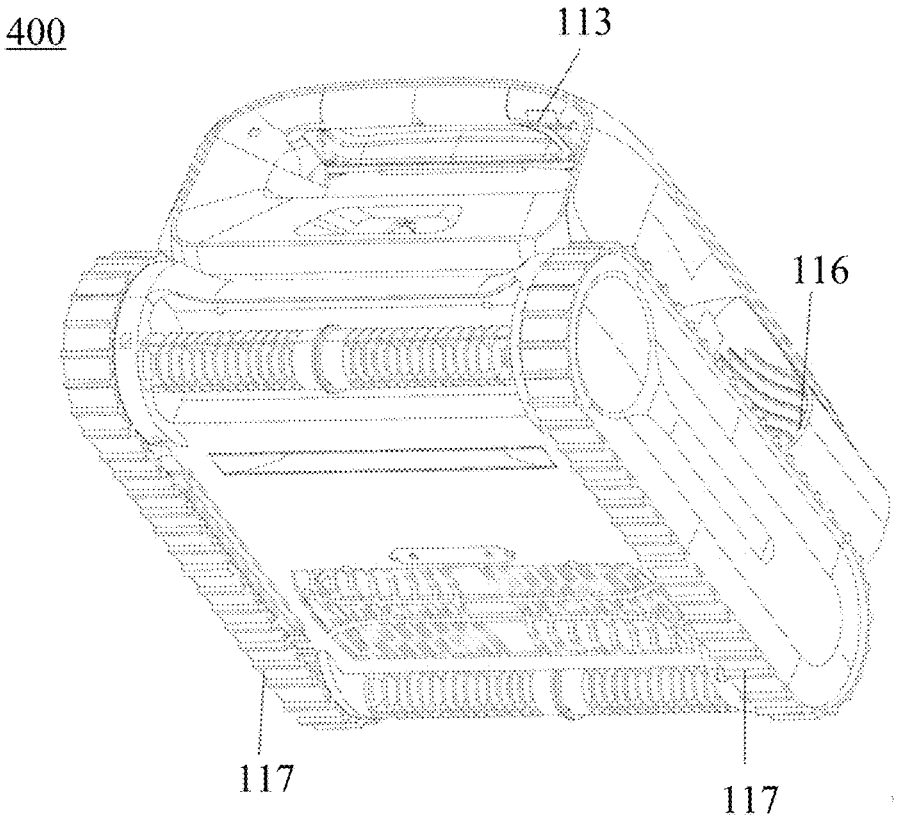
FIG. 12 is a schematic structural view of a cleaning device according to an embodiment of the present disclosure.

FIG. 12 is a schematic structural view of a cleaning device according to an embodiment of the present disclosure. The cleaning device 400 includes a front portion and a rear portion. The cleaning device 400 further includes a mode switching member 110. The mode switching member 110 includes a buoyancy cavity 111, a first adjustment part 112, at least one first injection opening 113, and a cleaning member 410. The buoyancy cavity 111 is configured to accommodate liquid or gas. The first adjustment part 112 is configured to adjust the volume of gas or liquid in the buoyancy cavity 111. The at least one first injection opening 113 is provided at the front portion of the cleaning device 400 and communicates with the buoyancy cavity 111 for external gas or external liquid to enter the buoyancy cavity 111. After the first injection opening 113 of the cleaning device 400 is exposed above a liquid surface, the first adjustment part 112 is turned on to input gas input into the buoyancy cavity 111 through the first injection opening 113, so that the rear portion of the cleaning device 400 moves toward the liquid surface. In this way, the cleaning device 400 is switched from a second motion state to a third motion state.

Therefore, the mode switching member 110 is disposed on the cleaning device 400, so that pose switching of the cleaning device among a first motion state, the second motion state, and the third motion state can be implemented, and pose switching of the cleaning device 400 between a position on the liquid surface and a position under the liquid surface can be implemented. When the cleaning device 400 is located under the liquid surface, the cleaning device 400 can perform underwater cleaning and clean a side wall 320, a bottom wall 310, and the like. When the cleaning device 400 is located on the liquid surface, the cleaning device 400 can clean the liquid surface. The mode switching member 110 is disposed on the cleaning device 400, so that the cleaning device 400 can perform pose switching between the position on the liquid surface and the position under the liquid surface. In this way, the cleaning device 400 can clean a liquid environment in an all-round way. This improves an application scope and working efficiency in cleaning the liquid environment and reduces liquid environment cleaning costs.

The cleaning device 400 further includes the cleaning member. The cleaning member includes a filtering mechanism. The filtering mechanism is configured to perform filtering in the cleaning device. The filtering mechanism is at least partially located in the cleaning device and is configured to collect stains and suspended matters from the target region 300 and filter liquid and the like.

In one embodiment, the cleaning device 400 includes a liquid inlet portion and a water outlet portion. The liquid inlet portion is configured to allow liquid to enter a cleaning device body. The liquid inlet portion includes at least a first water inlet. The first water inlet is provided at the cleaning device body. In other words, the liquid enters the cleaning device body through the first water inlet. The water outlet portion is configured to allow liquid that passes through the filtering mechanism to be discharged from the cleaning device body. The water outlet portion includes at least a first water outlet. The first water outlet is provided at the cleaning device body. In other words, the liquid is discharged from the cleaning device body through the first water outlet. The first water inlet, the filtering mechanism, a drive mechanism, and the first water outlet sequentially communicate with each other to form a first water flow path. Under guidance of the drive mechanism, the liquid enters the cleaning device body through the first water inlet, flows to the filtering mechanism and the drive mechanism, and then is discharged through the first water outlet. In an actual process, the liquid may flow reversely. In other words, the liquid sequentially flows to the first water outlet, the drive mechanism, the filtering mechanism, and the first water inlet. During reverse flowing, the filtering mechanism may perform self-cleaning. In other words, a water flow enters the filtering mechanism through an outlet of the filtering mechanism (for example, an outer surface of a filtering mesh of the filtering mechanism), flows out of the filtering mechanism through an inlet of the filtering mechanism, and then flows out of the cleaning device 400 through the first water inlet. In this way, particles or objects adhered to an inner surface of the filtering mesh of the filtering mechanism and garbage inside the filtering mechanism can be discharged from the filtering mechanism.

In one embodiment, the liquid inlet portion includes the first water inlet. The first water inlet is located at a lower front portion of the cleaning device body. The first water inlet is configured to perform both underwater cleaning and water surface cleaning. When the cleaning device 400 performs underwater cleaning, the first water inlet is located under the liquid surface, so that garbage under the liquid surface can be sucked. When the cleaning device 400 performs water surface cleaning, the first water inlet is at least partially exposed above the liquid surface or close to the liquid surface, so that garbage floating at the liquid surface can be sucked. In other words, the cleaning device body can implement underwater cleaning and water surface cleaning through the first water inlet and by adjusting a posture of the cleaning device 400 in the target region 300 by the mode switching member, so that cleaning efficiency is improved. Liquid sequentially flows through the first water inlet, a first inlet, the filtering mechanism, the outlet, the drive mechanism, and the liquid outlet portion, so that a water path for performing a cleaning operation is formed. In the above embodiment, when the cleaning device 400 performs underwater cleaning, the posture of the cleaning device 400 is in a normal state. When the cleaning device 400 performs water surface cleaning, the front portion of the cleaning device 400 is lifted upward to be exposed above the liquid surface, so that the first water inlet is at least partially exposed above the liquid surface.

In other embodiments, the liquid inlet portion includes the first water inlet. The first water inlet is located at the bottom of the cleaning device body. The first water inlet is used in performing both underwater cleaning and water surface cleaning. When the cleaning device 400 performs underwater cleaning, the first water inlet is located under the liquid surface and faces a to-be-cleaned surface. When the cleaning device 400 performs water surface cleaning, the first water inlet is located under the liquid surface but is close to the liquid surface and faces the liquid surface. In this case, when reaching the liquid surface, the cleaning device 400 flips over. In other words, the cleaning device body can implement underwater cleaning and water surface cleaning through the first water inlet and by adjusting the posture of the cleaning device 400 in the target region 300, so that cleaning efficiency is improved. Liquid sequentially flows through the first water inlet, a first inlet, the filtering mechanism, the outlet, the drive mechanism, and the liquid outlet portion. In the above embodiment, when the cleaning device 400 performs underwater cleaning, the posture of the cleaning device 400 is in a normal state. When the cleaning device 400 performs water surface cleaning, the cleaning device 400 can flip over, that is, the bottom of the cleaning device 400 faces upward. When the bottom of the cleaning device 400 faces upward, the filtering mechanism may be in a closed state, so that a risk of leaking garbage from the filtering mechanism is reduced.

In one embodiment, the liquid inlet portion includes at least the first water inlet and a second water inlet. The first water inlet is located at the bottom of the cleaning device body. When the cleaning device 400 cleans the bottom or a wall of the pool, the first water inlet is close to the bottom or the wall of the pool, so that water is sucked into the cleaning device 400. The liquid inlet portion includes the second water inlet. In other words, liquid enters the cleaning device body through the second water inlet. The second water inlet is provided at a side surface of the front portion of the cleaning device body. When the cleaning device 400 performs water surface cleaning, the second water inlet is at least partially exposed above the liquid surface, so that garbage floating at the liquid surface can be sucked. In this way, a third water path for performing a cleaning operation in the third motion state is formed. The cleaning device 400 can implement water surface cleaning through the second water inlet. In addition, the first water inlet and the second water inlet may operate cooperatively to improve the cleaning efficiency of the cleaning device 400.

In one embodiment, the liquid inlet portion includes the first water inlet and a second water inlet. In addition to being provided at the lower front portion of the cleaning device body, the first water inlet may alternatively be provided at a lower rear portion of the cleaning device body or a side surface of the cleaning device body. It should be noted that a position of the liquid inlet portion is related to a position of the filtering mechanism. When the filtering mechanism is disposed at the front portion of the cleaning device, the liquid inlet portion is provided at the front portion of the cleaning device 400. When the filtering mechanism is disposed at the rear portion of the cleaning device 400, the liquid inlet portion is provided at the rear portion of the cleaning device 400.

In one embodiment, the filtering mechanism includes a filtering assembly. The filtering assembly has a filtering function. The filtering assembly includes a first inlet. The first water inlet and/or the second water inlet are/is in fluid communication with the first inlet of the filtering assembly. Under the action of the drive mechanism, at least a part of liquid sequentially flows through the first water inlet, the first inlet, the filtering assembly, the drive mechanism, and the liquid outlet portion. At least a part of the liquid sequentially flows through the second water inlet, the first inlet, the filtering assembly, the drive mechanism, and the liquid outlet portion. The first water inlet and the second water inlet both communicate with the first inlet to improve the cleaning efficiency of the cleaning device 400. The second water inlet and the first inlet may communicate with each other through a duct or the like, and/or the first water inlet and the first inlet may communicate with each other through a duct or the like.

The filtering mechanism may include one, two, three, or more filtering assemblies. A quantity of filtering assemblies may be determined based on an actual requirement. When there are two, three, or more filtering assemblies, adjacent filtering assemblies may be connected to each other in series or in parallel, which may be determined based on various use requirements of the cleaning device 400. This is not limited herein.

In one embodiment, the filtering mechanism includes one filtering assembly. The filtering assembly includes the first inlet and a second inlet. The first water inlet is in fluid communication with the first inlet of the filtering assembly. The second inlet and the first inlet are located on different surfaces of the filtering mechanism. In other words, at least a part of the liquid sequentially flows through the first water inlet, the first inlet, the filtering assembly, the drive mechanism, and the liquid outlet portion. The second water inlet communicates with the second inlet of the filtering assembly. In other words, at least a part of the liquid sequentially flows through the second water inlet, the second inlet, the filtering assembly, the drive mechanism, and the liquid outlet portion. The first water inlet is in fluid communication with the first inlet, and the second water inlet is in fluid communication with the second inlet, so that liquid flow paths are increased. In this way, cleaning requirements of at least two operating conditions: underwater cleaning and water surface cleaning are met, thereby meeting various use requirements.

In one embodiment, the filtering mechanism includes two filtering assemblies. The two filtering assemblies include a first filtering assembly and a second filtering assembly. The first filtering assembly is provided with the first inlet. The second filtering assembly is provided with a second inlet. The first water inlet is in fluid communication with the first inlet of the first filtering assembly. In other words, at least a part of the liquid sequentially flows through the first water inlet, the first inlet, the first filtering assembly, the drive mechanism, and the liquid outlet portion. The second water inlet is in fluid communication with the second inlet of the second filtering assembly. In other words, at least a part of the liquid sequentially flows through the second water inlet, the second inlet, the second filtering assembly, the drive mechanism, and the liquid outlet portion. The two filtering assemblies are configured to implement different liquid flow paths to improve the cleaning efficiency of the cleaning device 400.

In one embodiment, the liquid inlet portion includes the first water inlet and the second water inlet. The filtering mechanism includes the first filtering assembly and the second filtering assembly. The second filtering assembly is sleeved inside the first filtering assembly. The first water inlet communicates with the first inlet of the first filtering assembly. The first water inlet is configured to allow the liquid to enter the first filtering assembly through the first inlet. The second water inlet communicates with the second inlet of the second filtering assembly. The second water inlet is configured to allow the liquid to enter the second filtering assembly through the second inlet. When the cleaning device 400 performs underwater cleaning, the liquid sequentially flows through the first water inlet, the first inlet, the first filtering assembly, and a main water pump 118, so that the cleaning device 400 implements underwater cleaning. When the cleaning device 400 performs water surface cleaning, the liquid sequentially flows through the second water inlet, the second inlet, the second filtering assembly, the first filtering assembly, and the main water pump 118, so that the cleaning device 400 implements water surface cleaning. When the cleaning device 400 performs water surface cleaning, the liquid flows through double layers of filtering boxes, so that the cleaning efficiency of the cleaning device 400 in water surface cleaning is improved.

By connecting the two filtering assemblies in series, the first water inlet communicates with the first inlet of the first filtering assembly, and the second water inlet communicates with the second inlet of the second filtering assembly, so that the cleaning device 400 can perform underwater cleaning and water surface cleaning. This expands usage scenarios of the cleaning device 400 and improves user experience. Structures of the first filtering assembly and the second filtering assembly may be substantially the same or different. This is not limited herein.

When the cleaning device 400 performs underwater cleaning, the second water inlet or the second inlet may be closed to prevent the second water inlet, the second filtering assembly, and the main water pump from diverting liquid and to ensure a liquid sucking effect at the first water inlet and the first inlet. In other words, after the cleaning device 400 is switched from the second motion state to the third motion state, a second water path is closed. In an actual process, when a power of the main water pump 118 is sufficiently high, the second water inlet or the second inlet may alternatively not be closed. Similarly, when the cleaning device 400 performs water surface cleaning, the first water inlet or the first inlet may be closed to prevent the first water inlet, the first filtering assembly, and the main water pump 118 from diverting liquid and to ensure the liquid sucking effect at the second water inlet and the second inlet. In an actual process, when the power of the main water pump 118 is sufficiently high, the first water inlet or the first inlet may alternatively not be closed.

In one embodiment, the cleaning device 400 may include a control member. The control member of the cleaning device 400 controls the cleaning device 400 to be switched between the position on the water surface and the position under the water surface of the swimming pool, to implement water surface cleaning or underwater cleaning.

In some embodiments, the filtering mechanism includes a filtering box. The filtering box may be used in performing water surface cleaning and underwater cleaning on the swimming pool. The filtering box may include a filtering box water inlet portion. The filtering box water inlet portion communicates with the liquid inlet portion. The filtering box water inlet portion is an inlet for garbage or other debris in the swimming pool to enter the cleaning device 400.

In one embodiment, the filtering box may further include a filtering box roller brush assembly. The filtering box may include one or more filtering box roller brush assemblies. The filtering box roller brush assembly may be configured to draw garbage or other debris on the water surface into the filtering box during water surface cleaning, to improve water surface cleaning efficiency. The filtering box roller brush assembly may be disposed in a filtering box opening for water surface cleaning. The filtering box roller brush assembly may be disposed inside the filtering box opening for water surface cleaning.

In one embodiment, the filtering box roller brush assembly may alternatively be disposed outside the filtering box opening for water surface cleaning or on the filtering box opening for water surface cleaning.

The control member may be configured to control the cleaning device 400 to perform water surface cleaning or underwater cleaning for the swimming pool. In some embodiments, the control member may obtain a target task for cleaning a target swimming pool, where the target task includes water surface cleaning and underwater cleaning; determine an adjustment parameter of the cleaning device 400 based on the target task and a current position of the cleaning device 400; and control, based on the adjustment parameter, the cleaning device 400 to drive the cleaning device 400 to move to a target position to perform the target task.

The cleaning device 400 may comprehensively clean the bottom of the swimming pool, perform underwater cleaning, and perform water surface cleaning to ensure comprehensive cleaning of the swimming pool.

In one embodiment, the cleaning device 400 may further include a roller brush for underwater cleaning. The roller brush for underwater cleaning may be configured to clean the target bottom wall 310 and the target side wall 320 of the swimming pool. The cleaning device 400 may include one or more roller brushes for underwater cleaning. The roller brush for underwater cleaning may be disposed at the bottom of and/or on the side of the cleaning device 400. When the cleaning device 400 moves on the bottom of the swimming pool, the roller brush for underwater cleaning can clean the bottom of the swimming pool (such as cleaning debris or algae). When the cleaning device 400 moves on the wall of the swimming pool, the roller brush for underwater cleaning may further clean the wall of the swimming pool.

It should be noted that the above description of the cleaning device 400 and various members thereof is merely for ease of description and does not limit the present disclosure to the scope of the cited embodiments. It may be understood that a person skilled in the art, with understanding of the principle of the device, may make any combination of the various members or form a sub-member to be connected to other members without departing from the principle.

In one embodiment, the cleaning device body includes at least one filtering box cavity. The filtering mechanism includes at least one filtering assembly. The filtering assembly includes at least one filtering box, a first filtering layer, at least one flow guiding opening, and a cover part. A first cavity is formed in the filtering box. The filtering box is at least partially fixedly disposed inside the cleaning device 400 and moves along with the cleaning device 400. The filtering box includes at least a first motion state and a second motion state. The first filtering layer is disposed at least on a side wall of the filtering box. The first filtering layer communicates with the first cavity. The flow guiding opening is provided on the filtering box and/or the first filtering layer. For example, the flow guiding opening may be provided on the filtering box, the flow guiding opening may be provided on the first filtering layer, or the flow guiding opening may be provided on both the filtering box and the first filtering layer. When the filtering box is in the first motion state, the cover part seals and covers the flow guiding opening. When the filtering box is in the second motion state, the cover part is opened to expose the flow guiding opening. It may understood that opening the flow guiding opening indicates that at least a part of water can flow out of the filtering box through the flow guiding opening. When the cleaning device 400 is in operation, the filtering box is fixedly disposed inside the cleaning device 400. Therefore, the first motion state, the second motion state, and the third motion state of the cleaning device 400 may also indicate the first motion state, the second motion state, and a third motion state of the filtering box.

The filtering box water inlet portion of the filtering box is configured to allow water to enter the first cavity. The first filtering layer is configured to perform filtering. The water enters the first cavity of the filtering box through the filtering box water inlet portion, and the first filtering layer filters debris in the water out. The filtered water enters the filtering box cavity of the filtering assembly, flows through the main water pump 118 through the filtering box cavity, and then is discharged from the cleaning device 400.

The first motion state or the third motion state may be a state of the filtering assembly when the cleaning device 400 cleans the bottom of the pool or the water surface. In the first motion state or the third motion state, the filtering assembly is in a normal state, the cover part covers the flow guiding opening, and a thrust generated by the water normally flowing through the filtering assembly is not sufficient to push the cover part to be opened to expose the flow guiding opening. The second motion state is a state of the filtering assembly when the cleaning device 400 climbs a slope or a wall under the water surface or when the first filtering layer is clogged. In the second motion state, the filtering assembly tilts, is inverted, or is in an operating state with the cleaning device 400, and the cover part moves under the action of gravity and/or an external force, such as the thrust generated by the water flow, so that the flow guiding opening is opened. The first motion state or the second motion state is different from the third motion state.

When the filtering box is in the first motion state or the third motion state, the cover part covers the flow guiding opening, and the water in the first cavity flows out through the first filtering layer of the filtering box to reduce impact on a cleaning effect of the cleaning device 400, so that the cleaning device 400 implements the normal cleaning function.

When the filtering assembly is in the second motion state, the cover part is gradually opened to expose the flow guiding opening. At least a part of the water in the first cavity flows out directly through the flow guiding opening. This increases an amount of water flowing out of the filtering box. In this way, when the cleaning device 400 climbs the wall or the slope or when the first filtering layer is clogged to a certain extent, a requirement for the amount of water flowing into the main water pump 118 can always be met, so that the cleaning device 400 can stably climb the wall or the slope or operate stably. Therefore, the cleaning device 400 can be applied to more situations, such as underwater cleaning and water surface cleaning.

For example, when the filtering assembly operates in the first motion state or the third motion state, and the first filtering layer is not clogged by stains to a certain extent, the filtering assembly is in a normal operating state. When the cleaning device 400 climbs the wall or the slope, the cover part is opened under the action of gravity of the cover part or an external force to expose the flow guiding opening, so that the cleaning device 400 can stably climb the wall or the slope.

When the filtering assembly operates in the first motion state or the third motion state, and the first filtering layer is clogged by stains to a certain extent, the filtering assembly cannot operate normally. In this case, the cover part is opened to expose the flow guiding opening to increase the amount of water flowing into the main water pump 118 and maintain stable operation performance of the cleaning device 400, so that the cleaning device 400 can stably climb the slope or the wall.

When the cleaning device 400 climbs the slope, the cover part is opened under the action of gravity of the cover part or the external force to expose the flow guiding opening, so that the cleaning device 400 can stably climb the wall or the slope.

Therefore, the first cavity, the flow guiding opening, and the cover part of the filtering box cooperate with each other, so that when the filtering box is in the first motion state or the third motion state, the cover part covers the flow guiding opening to reduce impact on the cleaning effect of the cleaning device 400. When the filtering box is in the second motion state, the cover part is opened to expose the flow guiding opening to increase the amount of water flowing out of the first cavity and increase the amount of water flowing into the main water pump 118. In this way, a thrust applied to the cleaning device 400 is improved, so that wall climbing or slope climbing or operating performance of the cleaning device 400 is improved. This improves user experience.

The flow guiding opening may include one flow guiding sub-opening, or the flow guiding opening may include more than two flow guiding sub-openings, such as two flow guiding sub-openings, three flow guiding sub-openings, or a plurality of flow guiding sub-openings. A quantity of flow guiding sub-openings may be determined based on an actual situation. When there are a plurality of flow guiding sub-openings, an amount of water flowing out from the flow guiding opening formed by the plurality of flow guiding sub-openings needs to be substantially equal to an amount of water flowing out from the flow guiding opening formed by one flow guiding sub-opening to ensure the amount of water flowing out from the flow guiding opening to be consistent. In this way, the requirement for the amount of water flowing into the main water pump 118 can always be met when the cleaning device 400 climbs the wall or the slope or when the first filtering layer is clogged to a certain extent, so that the cleaning device 400 can stably climb the wall or the slope or operate stably.

There may be one, two, three, or four flow guiding openings. This is not limited herein. A periphery of the filtering box is hollow. The first filtering layer is located at a hollowed region. The flow guiding opening may be provided at the hollowed region of the filtering box or at a position of the filtering box other than the hollowed region, or the flow guiding opening is provided on the first filtering layer. When the flow guiding opening is provided on the first filtering layer, a periphery of the flow guiding opening is defined by the filtering box, so that the cover part more stably covers the flow guiding opening or is opened to expose the flow guiding opening.

In some embodiments, the cover part may be driven by a drive assembly. The drive assembly is connected to the cover part, so that the cover part covers the flow guiding opening or is opened to expose the flow guiding opening. The drive assembly may include a drive motor. The drive motor is connected to the cover part to control the cover part to move. Alternatively, a related structure is disposed on the cover part, and the cover part is driven by the cover part and the related structure, so that the cover part covers the flow guiding opening or is opened to expose the flow guiding opening. In other embodiments, the cover part may cover the flow guiding opening or be opened to expose the flow guiding opening in other manners. This is not limited herein. The cover par may be a cover plate, a flipping plate, or the like.

The cover part may be mounted on the filtering box. The cover part may be mounted on the filtering box through pivoting, telescoping, hinging, or the like, to cover the flow guiding opening or be opened to expose the flow guiding opening.

In one embodiment, the cover part is pivotally connected to the filtering box. When the cover part is pivotally connected to the filtering box, it is more labor-saving for the cover part to cover the flow guiding opening or be opened to expose the flow guiding opening. The filtering assembly further includes adjustment parts mounted on the cover part. The adjustment parts are away from a pivoting joint between the cover part and the filtering box. Mounting positions of the adjustment parts are away from the pivoting joint between the cover part and the filtering box. The adjustment parts assist the cover part in covering the flow guiding opening or being opened to expose the flow guiding opening.

In the first motion state or the third motion state, a pivot point at which the cover part rotates around the filtering box is located on an action line of a sum of gravity and a buoyancy force applied to the cover part and the adjustment parts. In other words, a rotation moment of the cover part around the filtering box is zero. Therefore, the cover part does not pivot and always remains in a vertical state to better cover the flow guiding opening.

In the second motion state, the filtering assembly tilts or is flipped and inverted, and the pivot point at which the cover part rotates around the filtering box deviates from the action line of the sum of the gravity and the buoyancy force applied to the cover part and the adjustment parts. In other words, the rotation moment of the cover part around the filtering box is not zero, so that the cover part has the rotation moment for rotating around the filtering box to force the cover part to rotate to open the flow guiding opening. The adjustment parts may have different densities, provided that the adjustment parts can assist the cover part in moving. Specific structures of the adjustment parts are not limited herein. In another second state, when the first filtering layer of the filtering assembly is clogged, and the filtering assembly does not obviously tilt or is not flipped and inverted, a large pressure difference between the filtering box cavity and the first cavity is formed due to a pumping action of the main water pump 118. In response to the pressure difference, the cover part can be opened to expose the flow guiding opening to balance the pressure difference.

The adjustment parts are disposed and mounted on the cover part, so that the cover part can more quickly cover the flow guiding opening or be opened to expose the flow guiding opening, and the amount of water flowing out from the first cavity is increased to improve the amount of water flowing into the main water pump 118. In this way, the wall climbing or slope climbing or operating performance of the cleaning device 400 is improved. In addition, the cover part can be switched autonomously between the first motion state or the third motion state and the second motion state to reduce usage of the drive assembly. This reduces costs.

Specifically, the cover part includes a first end and a second end opposite to each other. When the filtering assembly is in the first motion state or the second motion state, the first end is located at an uppermost end of the cover part, and the second end is located at a lowermost end of the cover part. Both the first end and the second end may be configured to be pivotally connected to the filtering box. However, because the first end and the second end are disposed at different positions, a force applied to the cover part when the first end is pivotally connected to the filtering box is different from a force applied to the cover part when the second end is pivotally connected to the filtering box. To close the flow guiding opening in the first motion state or the third motion state and open the flow guiding opening in the second motion state, when the first end or the second end is pivotally connected to the filtering box, the positions of the adjustment parts need to be adjusted to assist a force in being applied to the cover part.

It may be understood that the cover part of the filtering assembly in this embodiment of the present disclosure is further provided with a second filtering layer. When the cover part is not opened, the second filtering layer filters debris to prevent normal operation of the cleaning device 400 from being affected by the cover part. A specific position and a form of the second filtering layer are not limited herein, provided that a position at which the second filtering layer is provided avoids the positions at which the adjustment parts are disposed.

The cover part may be movably connected to the cleaning device 400. For example, the cover part may be mounted on a component of the cleaning device 400 other than the filtering box through pivoting, telescoping, hinging, or the like. The cover part is configured to cover the flow guiding opening or be opened to expose the flow guiding opening. When the cover part is pivotally connected to the cleaning device 400, a structure of the cover part is the same as the structure of the above cover part that is pivotally connected to the filtering box. Details are not described herein again. In other words, the cover part may be disposed at various positions. A specific position of the cover part is determined based on an actual situation.

In some embodiments, the cleaning device 400 includes a filtering assembly. The filtering assembly is the filtering assembly described in the above embodiments. Details are not described herein again. The filtering assembly is disposed, so that the impact on the cleaning effect of the cleaning device 400 can be reduced, and the amount of water flowing into the main water pump 118 can be increased. In this way, the thrust applied to the cleaning device 400 is increased, so that wall climbing or slope climbing or operating performance of the cleaning device 400 is improved. This improves user experience.

In one embodiment, the filtering box water inlet portion is formed in the filtering box. The filtering box water inlet portion communicates with the first cavity. In other words, water flows into the first cavity through the filtering box water inlet portion. The cleaning device 400 further includes the main water pump 118. The main water pump 118 is disposed outside the filtering box. The main water pump 118 communicates with the first cavity of the filtering box. The main water pump 118 provides a driving force to drive the water to flow and guide a flow direction of the water.

When the filtering assembly is in the first motion state or the third motion state, the cover part covers the flow guiding opening. The main water pump 118 is configured to guide the water to flow into the main water pump 118 sequentially through the filtering box water inlet portion, the first cavity, and the first filtering layer. In other words, the main water pump 118 is configured to guide the water in the pool to flow into the first cavity through the filtering box water inlet portion, and the water in the first cavity flows into the main water pump 118 through the first filtering layer on the filtering box.

When the filtering assembly is in the second motion state, the cover part is opened to expose the flow guiding opening. The main water pump 118 is configured to guide at least a part of the water to flow into the main water pump 118 sequentially through the filtering box water inlet portion, the first cavity, and the flow guiding opening. In other words, the main water pump 118 is configured to guide the water in the pool to flow into the first cavity through the filtering box water inlet portion, at least a part of the water in the first cavity directly flows into the main water pump 118 through the flow guiding opening, and another part of the water flows into the main water pump 118 through the first filtering layer.

Therefore, the main water pump 118 provides a driving force to drive the water to flow and limits the flow direction of the water, and a requirement for the amount of water flowing into the main water pump 118 can always be met. In this way, stable wall climbing or slope climbing or operating performance of the cleaning device 400 can be maintained.

In one embodiment, the cleaning device 400 includes the filtering box cavity. A second cavity is formed in the filtering box cavity. The filtering assembly is disposed inside the second cavity. The second cavity communicates with the first cavity of the filtering box in the filtering assembly. For example, the second cavity may communicate with the first cavity through the first filtering layer and the flow guiding opening. The main water pump 118 is disposed outside the filtering box cavity. The filtering box water inlet portion is formed between the filtering box and the filtering box cavity. The filtering box water inlet portion communicates with the first cavity. In other words, water flows into the first cavity through the filtering box water inlet portion. A position and a disposition manner of the filtering box water inlet portion are not limited herein, provided that the water can directly enter the first cavity through the filtering box water inlet portion.

When the cleaning device 400 is placed in the pool, the main water pump 118 is configured to guide water in the pool to flow into the first cavity through the filtering box water inlet portion, and then the water flows into the second cavity after being filtered by the first filtering layer, and the water flows into the main water pump 118 through the second cavity.

When the filtering assembly is in the first motion state or the third motion state, the cover part covers the flow guiding opening. The main water pump 118 is configured to guide water to flow into the main water pump 118 sequentially through the filtering box water inlet portion, the first cavity, the first filtering layer, and the second cavity. In other words, the main water pump 118 is configured to guide the water in the pool to flow into the first cavity through the filtering box water inlet portion, the water in the first cavity flows into the second cavity through the first filtering layer on the filtering box, and then the water flows into the main water pump 118 through the second cavity. The first motion state or the third motion state is a state of the filtering box when the cleaning device 400 moves in a direction perpendicular to the gravity direction, or the first motion state or the third motion state is a state in which the cleaning device 400 is disposed at a certain tilting angle, and the cover part cannot be opened under the gravity of the cover part or an external force to expose the flow guiding opening.

When the filtering box of the filtering assembly is in the second motion state, the cover part is opened to expose the flow guiding opening. The main water pump 118 is configured to guide at least a part of the water to flow into the main water pump 118 sequentially through the filtering box water inlet portion, the first cavity, the flow guiding opening, and the second cavity. In other words, the main water pump 118 is configured to guide the water in the pool to flow into the first cavity through the filtering box water inlet portion, at least a part of the water in the first cavity directly flows into the second cavity through the flow guiding opening, another part of the water flows into the second cavity through the first filtering layer, and then the water flows into the main water pump 118 through the second cavity.

The filtering box cavity is disposed in the cleaning device 400, so that the water can be concentrated in the second cavity and concentratedly flow into the main water pump 118 to improve the requirement for the amount of water flowing into the main water pump 118. In this way, the wall climbing or slope climbing or operating performance of the cleaning device 400 is further improved. The filtering box cavity is provided with a water outlet. The water outlet communicates with the main water pump 118. A side wall of the filtering box cavity is close to the main water pump 118, and the side wall is provided with the water outlet, or the water outlet may be provided at other positions on the filtering box cavity. This is not limited herein.

In one embodiment, the cover part is pivotally connected to the filtering box cavity. A structure of the cover part pivotally connected to the filtering box cavity is the same as a structure of the cover part pivotally connected to the filtering box. Details are not described herein again. The cover part is disposed on the filtering box cavity to reduce a resistance applied by the cover part against the water flow, so that the water can flow out of the filtering box more smoothly. For example, the cover part may be disposed on the side wall of the filtering box cavity to cover the flow guiding opening or be opened to expose the flow guiding opening.

In a process in which the cover part is opened to expose the flow guiding opening, when the cleaning device 400 is switched from the second state to the first state, the cover part can be automatically reset due to the structure thereof, so that the cover part covers the flow guiding opening. Certainly, a reset assembly may be disposed between the cover part and the filtering box or between the cover part and the filtering box cavity. Resetting can be implemented quickly by the reset assembly. The reset assembly may be a torsion spring, a spring, a tension spring, or the like. This is not limited herein.

In one embodiment, the cleaning device 400 further includes a flipping cover. The filtering box cavity has an opening. The flipping cover covers the opening to seal the filtering box cavity. The flipping cover is disposed on the top of the filtering box cavity. The flow guiding opening is provided at the top of the filtering box. In this case, the filtering box is partially hollowed and is provided with the flow guiding opening. The cover part is movably connected to the flipping cover to cover the flow guiding opening of the filtering box or be opened to expose the flow guiding opening of the filtering box. In other words, the cover part may be disposed on the flipping cover in addition to the filtering box cavity.

In other embodiments, when the top of the filtering box includes a fifth side surface, the cover part may be movably mounted on a top cover housing of the cleaning device 400. The top cover housing is an outermost housing of the cleaning device 400. When the top cover housing is opened, the filtering assembly can be removed from the cleaning device 400 and may be cleaned or replaced. The cover part covers the flow guiding opening on the fifth side surface or is opened to expose the flow guiding opening on the fifth side surface.

In another embodiment, when the top of the filtering box includes a fifth side surface, the flow guiding opening is formed on the fifth side surface. The cover part may be movably mounted on the fifth side surface to cover the flow guiding opening on the fifth side surface or be opened to expose the flow guiding opening on the fifth side surface.

In one embodiment, the cover part is further provided with a second filtering layer. The second filtering layer communicates with the first cavity and the second cavity. The second filtering layer is configured to perform filtering. When the filtering assembly is in the first motion state or the third motion state, the cover part covers the flow guiding opening. The water in the pool can flow into the first cavity through the filtering box water inlet portion. The water in the first cavity flows into the second cavity through the first filtering layer on the filtering box and the second filtering layer on the cover part. Then, the water flows into the main water pump 118 through the second cavity. The second filtering layer is disposed on the cover part, so that the cleaning efficiency of the cleaning device 400 can be improved. A structure of the second filtering layer may be the same as or different from the structure of the first filtering layer. This is not limited herein.

Because a size of garbage on the liquid surface is larger than a size of garbage under the liquid surface, a size of a filtering mesh hole of the first filtering layer of the filtering assembly when the cleaning device 400 performs water surface cleaning is larger than a size of a filtering mesh hole of the first filtering layer of the filtering assembly when the cleaning device 400 performs underwater cleaning. In some embodiments, the filtering box may be provided with two or more first filtering layers. The cover part covers the flow guiding opening on the filtering assembly or is opened to expose the flow guiding opening on the filtering assembly. When the cleaning device 400 performs underwater cleaning, the cover part covers the flow guiding opening. The plurality of first filtering layers are stacked to perform filtering, so that a filtering efficiency for underwater cleaning is increased. When the cleaning device 400 performs water surface cleaning, the cover part is at least partially opened to expose the flow guiding opening, and the flow guiding opening is used, so that a quantity of first filtering layers is reduced. In this way, large garbage on the liquid surface can be filtered easily, and the large garbage is less likely to block the plurality of first filtering layers. A structure, a disposition manner, and a position of the cover part are the same as those described above. Details are not described herein again.

In some embodiments, the cleaning device 400 includes a movement propulsion mechanism and a cleaning mechanism. The movement propulsion mechanism includes a transmission assembly. The transmission assembly includes a movement drive part, a first driven part, and a second driven part. The cleaning mechanism 400 includes a first cleaning part and a second cleaning part. The first cleaning part is configured to draw garbage under the liquid surface into the filtering mechanism. The second cleaning part is configured to draw garbage at the liquid surface into the filtering mechanism. For example, the first cleaning part in this embodiment is the roller brush for underwater cleaning, and the second cleaning part is the roller brush for water surface cleaning.

The movement drive part, the first driven part, and the second driven part are disposed, so that only one movement drive part can drive wheels, the first cleaning part, and the second cleaning part, leading to a simple driving structure and low manufacturing costs. The wheels are driven by the movement drive part to rotate, so that the wheels move forward or backward. During rotation, the wheels can drive the first driven part and the second driven part to rotate, so that the first driven part and the second driven part respectively drive the first cleaning part and the second cleaning part to rotate, and various cleaning parts can operate. In this way, cleaning functions of the cleaning device 400 are diversified. For example, the transmission assembly drives the wheels to rotate to drive the roller brush for underwater cleaning and the roller brush for water surface cleaning to rotate, so that cleaning functions of the cleaning device 400 are diversified. Optionally, the roller brush for underwater cleaning and the roller brush for water surface cleaning rotate in a same direction. In some embodiments, the wheels include a first wheel, a second wheel, and a track. The first wheel is in transmission connection to the second wheel through the track. An output end of the movement drive part is drivably connected to the first wheel. Specifically, two first wheels and two second wheels are disposed in this embodiment. The two first wheels are disposed at a front end of the cleaning device body, and the two second wheels are disposed at a rear end of the cleaning device body.

For example, the movement drive part in this embodiment includes a movement drive motor. The transmission assembly further includes a first gear. An output end of the movement drive motor is connected to the first gear. The first gear is engaged with the first wheel, so that the first gear can drive the first wheel to rotate. Alternatively, the movement drive part may be any other component that can provide kinetic energy. This is not limited herein.

Furthermore, the cleaning device 400 in this embodiment includes two transmission assemblies, two first wheels, and two second wheels. Each transmission assembly includes at least one first driven part, at least one movement drive part, and at least one second driven part.

The cleaning device body is further provided with the liquid inlet portion. At least one cleaning member is configured to expand a cleaning range of the liquid inlet portion. The cleaning member may be a side brush. The liquid inlet portion is configured to draw water flows, stains, and the like into the cleaning device body. The side brush is disposed on the side wall or the bottom of the cleaning device body. When the cleaning device 400 moves along an edge of the pool, the side brush may scrub the surface of the pool. There is a cleaning material on the side brush. The side brush moves around its own axis or reciprocates to scrub a to-be-cleaned object. The stains may be garbage floating on the pool, scale or black stains accumulated in the pool, or the like. The cleaning range of the liquid inlet portion is a range in which the liquid inlet portion may affect the water flow and the stains when the liquid inlet portion is in a state of sucking the water flow and the stains. The liquid inlet portion may be disposed on a front wall of the cleaning device body. Along an opening direction of the liquid inlet portion, the at least one cleaning member is located in the front of the liquid inlet portion. For example, the at least one cleaning member is disposed on a left side wall and/or a right side wall of the cleaning device body and extends toward the front wall. In addition, the cleaning member tilts toward the liquid inlet portion. A self-rotation direction of the cleaning member is a direction facing the liquid inlet portion, so that the cleaning member can stir a water flow and stains outside the cleaning range of the liquid inlet portion and guide the water flow and the stains to the liquid inlet portion.

In one embodiment, the cleaning device 400 includes an in-position detection mechanism for a filtering box. The in-position detection mechanism for the filtering box is configured to detect whether the filtering box is mounted in position on the cleaning device body to ensure that, only after the filtering box is mounted in position, the cleaning device 400 can operate normally. This eliminates any user misoperation, prevents ineffective cleaning or a poor cleaning effect, and better improves intelligence of the cleaning device 400.

While ensuring the cleaning effect of the cleaning device 400, the in-position detection mechanism for the filtering box can further prevent rigid debris from being sucked into a main water pump impeller, so that the main water pump impeller is prevented from being damaged or entangled, and the cleaning device 400 is prevented from malfunctioning. This helps improve operation safety and a service life of the cleaning device 400. The in-position detection mechanism for the filtering box includes at least one of a sensing assembly, an inductance assembly, and a switch assembly, which may be selected based on an actual situation.

In some embodiments, the in-position detection mechanism for the filtering box further includes an alarm part. The alarm part may give an alarm when the filtering box is not mounted in position, reminding a user to check a position of the filtering box in time to avoid a fault.

Based on the above description, the cleaning device 400 can implement cleaning in the pool in various scenarios, including bottom cleaning, wall cleaning, water surface cleaning, waterline cleaning, and water quality processing at a set depth in the pool.

During bottom cleaning and wall cleaning, a dust-loaded water flow is sucked through the first water inlet at the bottom of the cleaning device 400, enters the filtering mechanism through a filtering box opening for underwater cleaning of the filtering mechanism to be filtered, and then is discharged from the cleaning device body through the liquid outlet portion. In addition, at least one first cleaning part located at the bottom of the cleaning device 400 brushes the bottom and the wall of the pool. During waterline cleaning, the at least one first cleaning part of the cleaning device 400 brushes the waterline along the pool wall. In this way, stains adhering to the waterline are brushed off from the waterline and fall to the bottom of the pool or are partially drawn into the filtering mechanism of the cleaning device 400 through the first water inlet.

During water surface cleaning, at least one filtering box opening for water surface cleaning (may be the same as the filtering box opening for underwater cleaning) is provided at the cleaning device 400, so that garbage floating on the water surface is drawn into the filtering mechanism of the cleaning device 400. In addition, due to the impact of wind on the water surface, garbage may be blown to the wall or a corner of the pool. Due to the limitation of the structure, when the cleaning device 400 performs cleaning, the garbage at the waterline of the wall or the corner of the pool may be not cleaned. In this case, a nozzle may be disposed on the cleaning device 400 to blow the above garbage away from the waterline of the wall or the corner of the pool to a cleaning range of the filtering box opening for water surface cleaning. This improves the cleaning efficiency.

If the filtering mechanism has a filtering mesh structure, the filtering mechanism may be clogged by garbage, floating algae, and the like in the water during operation. Consequently, water cannot flow smoothly. This affects the amount of water discharged from the cleaning device 400. When the cleaning device 400 operates at the bottom or on the wall of the pool, the discharged water provides a counter thrust for the cleaning device 400 to be attached to the wall. Especially, when the cleaning device 400 operates on the wall of the pool, the cleaning device 400 is likely to tumble if the counter thrust is not sufficient. Therefore, a second water flow path may be provided in the filtering mechanism to cope with clogging of the filtering mesh structure in the filtering mechanism, so that the cleaning device 400 can be still stably attached to the wall and operate.

In some cases, because the first cleaning part is limited by the structure of the cleaning device 400 and the effective cleaning range of the cleaning device 400, some specific regions are difficult to clean, such as a certain range of a joint between the bottom and the wall of the pool, a certain range of a joint between walls of the pool, and the like. In this case, at least one rotary brush may be disposed on the cleaning device 400 to clean the above specific regions. To ensure that during the normal operation of the cleaning device 400, the rotary brush does not affect the operation of the cleaning device 400, the rotary brush may be configured in a telescopic manner. For example, the rotary brush may be controlled to extend and perform cleaning when needed, and when cleaning is completed, the rotary brush may be controlled to be retracted into the cleaning device 400. In one embodiment, the cleaning device 400 may further include a main roller brush. The main roller brush is configured to clean the bottom 310 and/or the side wall 320 of the pool. The cleaning device 400 may include one or more main roller brushes. The main roller brush may be provided on the bottom and/or a side of the cleaning device 400. One main roller brush may be provided at each of a front end and a rear end of the bottom of the cleaning device 400. The main roller brush may clean the bottom of the pool (for example, cleaning debris or algae) when the cleaning device 400 moves on the bottom of the pool. The main roller clean may further clean the wall of the pool when the cleaning device 400 moves on the wall of the pool.

Figure 13:
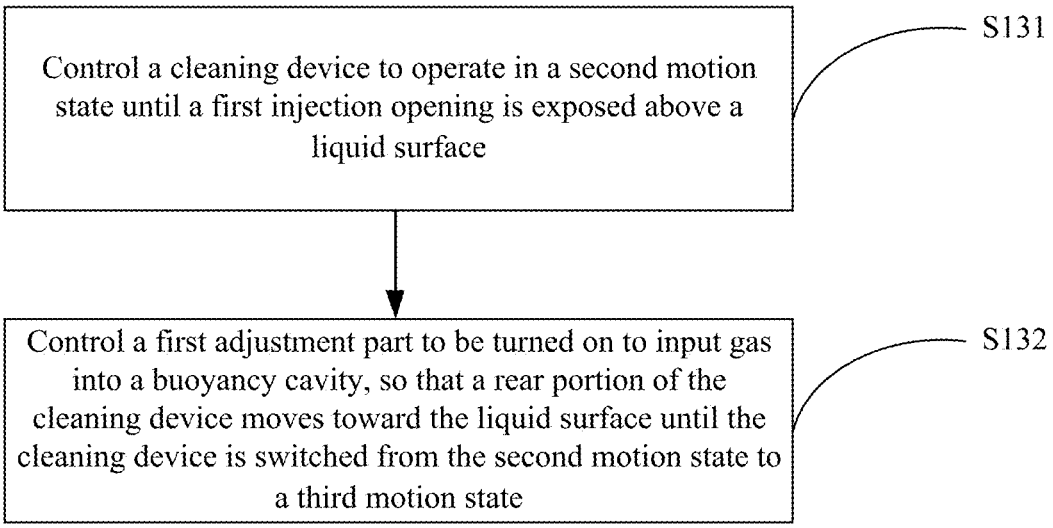
FIG. 13 is a schematic flowchart of a cleaning device control method according to an embodiment of the present disclosure.

FIG. 13 is a schematic flowchart of a cleaning device control method according to an embodiment of the present disclosure. The cleaning device includes a front portion and a rear portion. The cleaning device is adapted to operate in water. The cleaning device includes at least a first suction opening, a mode switching member, a control system, a moving mechanism, and a propulsion mechanism. The mode switching member includes a buoyancy cavity, a first adjustment part, and a first injection opening. The control system is connected to the first adjustment part, the moving mechanism, and the propulsion mechanism via signals. The first suction opening is configured to allow the cleaning device to perform a cleaning operation in a third motion state. The method in this embodiment includes the following steps.

Step S131: Control the cleaning device to operate in a second motion state until the first injection opening is exposed above a liquid surface.

Step S132: Control the first adjustment part to be turned on to input gas into the buoyancy cavity, so that the rear portion of the cleaning device moves toward the liquid surface until the cleaning device is switched from the second motion state to the third motion state.

In this embodiment, the first adjustment part is controlled to be turned on to input gas into the buoyancy cavity, so that the rear portion of the cleaning device moves toward the liquid surface until the cleaning device is switched from the second motion state to the third motion state. The second motion state includes a state in which the cleaning device moves on a side wall. The third motion state includes a state in which the first suction opening of the cleaning device is at least partially located above or close to the liquid surface. The cleaning device climbs upward along the side wall or in a direction substantially parallel to the side wall to a waterline. In this way, the first injection opening of the cleaning device is exposed above the liquid surface. The first adjustment part adjusts a volume of gas input into the buoyancy cavity through the first injection opening. When the volume of gas in the buoyancy cavity increases, a buoyancy force applied to the cleaning device increases. Because the front portion of the cleaning device is at least partially exposed above the liquid surface, the rear portion of the cleaning device floats upward, and the cleaning device begins to move from a vertical direction to a substantially horizontal direction until the rear portion of the cleaning device is at least partially located above the liquid surface or the rear portion at least moves toward the liquid surface for a certain distance relative to a position at which the rear portion of the cleaning device is located when the cleaning device is in the second motion state. In this way, the cleaning device is in the third motion state.

Figure 14:
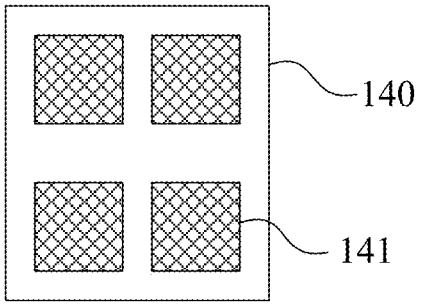
FIG. 14 is a schematic view of a framework of a computer-readable storage medium according to an embodiment of the present disclosure.

In one embodiment, FIG. 14 is a schematic view of a framework of a computer-readable storage medium according to an embodiment of the present disclosure.

The computer-readable storage medium 140 stores program instructions 141. When the program instructions 141 are executed by a processor, the steps in any one of the above method embodiments are implemented.

The computer-readable storage medium 140 may be specifically any medium that can store a computer program, such as a USB flash drive, a removable hard disk, a read-only memory (ROM, Read-Only Memory), a random access memory (RAM, Random Access Memory), a magnetic disk, or an optical disc, or may be a server storing the computer program. The server may send the stored computer program to another device to run the computer program, or the server may run the stored computer program.

If the technical solutions of the present disclosure involve personal information, before the product to which the technical solutions of the present disclosure are applied processes the personal information, an individual has been clearly informed of a personal information handling rule, and the individual has autonomously consented. If the technical solutions of the present disclosure involve sensitive personal information, before the product to which the technical solutions of the present disclosure are applied processes the sensitive personal information, the individual has separately consented, and a requirement of "express consent" is also met. For example, at a personal information collection apparatus such as a camera, a clear and conspicuous sign is set to inform that an individual has entered a personal information collection scope, personal information is to be collected, and if the individual voluntarily enters the collection scope, it indicates that the individual agrees about collection of his/her personal information; or in a case where the personal information processing rule is informed by using an obvious sign/information at a personal information processing apparatus, individual authorization is obtained by using pop-up information, asking the individual to upload his/her personal information by himself/herself, or the like. The personal information processing rule may include information, for example, a personal information processor, a personal information processing purpose, a processing manner, and types of processed personal information.

The above description describes only embodiments of the present disclosure and is not intended to limit the scope of the present disclosure. Any equivalent structure or equivalent process transformation performed based on contents of the specification and the accompanying drawings of the present disclosure or applied directly or indirectly in other related technical fields shall fall within the protection scope of the present disclosure.

What is claimed is:

1. A swimming pool robot, comprising:

a body provided with a buoyancy cavity, a pump and an air inlet, wherein the pump is configured to control gas to flow into the buoyancy cavity through the air inlet; a processor disposed in the body; and a sensor disposed in the body;

wherein when the swimming pool robot is to be switched from being underwater to floating on a water surface, the processor is configured to obtain from the sensor a detection result of whether the air inlet is located in air, and in response to the detection result indicating that the air inlet is located in air, the processor is configured to control the pump to increase a volume of the gas in the buoyancy cavity.

2. The swimming pool robot according to claim 1, wherein the sensor is configured to detect a position of the swimming pool robot, and wherein when the swimming pool robot is to be switched from being underwater to floating on the water surface, the processor is configured to obtain from the sensor the position of the swimming pool robot, and in response to the position of the swimming pool robot meeting a preset condition, the processor is configured to determine that the air inlet is above the water surface and controls the pump to increase the volume of the gas in the buoyancy cavity.

3. The swimming pool robot according to claim 1, wherein when the swimming pool robot is to be switched from being underwater to floating on the water surface, the swimming pool robot has a state where a bottom surface or a top surface of the swimming pool robot is inclined with respect to the water surface.

4. The swimming pool robot according to claim 1, wherein the air inlet is disposed at a handle of the swimming pool robot.

5. The swimming pool robot according to claim 1, wherein the swimming pool robot is provided with multiple buoyancy cavities, and wherein at least one of the buoyancy cavities is respectively provided on a front portion of the swimming pool robot.

6. The swimming pool robot according to claim 5, wherein two of the multiple buoyancy cavities are provided symmetrically at one end portion of the swimming pool robot.

7. The swimming pool robot according to claim 1, further comprising two propellers disposed in the swimming pool robot, wherein the two propellers are configured to propel water with different flow rates to enable the swimming pool robot to be turned around.

8. The swimming pool robot according to claim 1, further comprising a power water outlet portion rotatably disposed in the body and configured to change a flow direction of water.

9. The swimming pool robot according to claim 8, further comprising a motor and a transmission structure disposed in the swimming pool robot, wherein the transmission structure is in coordination with the motor to drive the power water outlet portion to rotate.

10. The swimming pool robot according to claim 8, further comprising a propeller, wherein:

the propeller and the power water outlet portion are in communication with each other through a channel, and an orientation of the channel is adjusted to allow water to be discharged from the power water outlet portion in a first direction or in a second direction, wherein the second direction is different from the first direction.

11. The swimming pool robot according to claim 1, further comprising:

a sensor disposed in the body, wherein the sensor is configured to detect whether a filtering box is in position; and an alarm part in communication with the processor and configured to prompt a user when the filtering box is not mounted in position.

12. The swimming pool robot according to claim 1, further comprising a first propeller and a second propeller, wherein:

the swimming pool robot is further provided with a first power water inlet portion, a second power water inlet portion, a first power water outlet portion, and a second power water outlet portion, the first propeller is in communication with the first power water inlet portion and the first power water outlet portion, and the second propeller is in communication with the second power water inlet portion and the second power water outlet portion.

13. The swimming pool robot according to claim 1, further comprising:

a dust box provided with a water surface dust box opening, wherein the dust box is configured to clean pool water that enters the dust box.

14. The swimming pool robot according to claim 13, wherein the dust box comprises a dust box roller provided in the water surface dust box opening and is configured to roll trash or impurities from the pool surface into the dust box when a surface cleaning is performed.

15. The swimming pool robot according to claim 13, further comprising: a trash guide member located on an outside of the water surface dust box opening and hollow inside and configured to guide trash in a water surface of the pool into the water surface dust box opening, wherein the water surface dust box opening is exposed to the pool water surface when the swimming pool robot performs water surface cleaning.

16. The swimming pool robot according to claim 15, the trash guide member comprising a first end that is away from the water surface dust box opening and the dust box, wherein a size of the first end is larger than a size of the water surface dust box opening.

17. The swimming pool robot according to claim 16, the trash guide member further comprising a second end that is connected to the water surface dust box opening and close to the dust box, a size of the second end is not smaller than the size of the water surface dust box opening.

* * * * *